United States Patent [19]

Mulla et al.

[11] Patent Number: 4,866,777

[45] Date of Patent: Sep. 12, 1989

[54] APPARATUS FOR EXTRACTING FEATURES FROM A SPEECH SIGNAL

[75] Inventors: Hoshang D. Mulla, Trumbull; Douglas Sutherland, Shelton; Priyadarshan Jaktdar, Hamden, all of Conn.

[73] Assignee: Alcatel USA Corporation, New York, N.Y.

[21] Appl. No.: 670,436

[22] Filed: Nov. 9, 1984

[51] Int. Cl.[4] ..... G10L 7/02; G10L 7/08

[52] U.S. Cl. ..... 381/41; 381/43

[58] Field of Search ..... 381/36-50, 381/29-32; 364/513.5, 485, 724

[56] References Cited

U.S. PATENT DOCUMENTS

| | | | |
|---|---|---|---|
| 3,473,121 | 10/1969 | Hurtig et al. | 381/41 |
| 3,509,281 | 4/1970 | King | 381/49 |
| 3,619,509 | 11/1971 | Barger et al. | 381/41 |
| 4,227,046 | 10/1980 | Nakajima et al. | 381/42 |
| 4,370,521 | 1/1983 | Johnston et al. | 381/41 |
| 4,573,187 | 2/1986 | Bui et al. | 381/43 |
| 4,624,008 | 11/1986 | Vensko et al. | 364/513.5 |
| 4,653,097 | 3/1987 | Watanabe et al. | 381/42 |

OTHER PUBLICATIONS

Bonnerot et al, "Digital Processing Techniques in the 60 Channel Transmuliplexor", IEEE Trans. Comm., vol. COM-26, No. 5, May 78, pp. 698-706.

Stearns, "*Digital Signal Analysis*", Hayden Book Company, 1975, pp. 102-103, 182-183.

Carlson, *Communication Systems*, McGraw-Hill, 1975, pp. 180-185.

Schafer, "Design of Digital Filter Banks for Speech Analysis", The Bell System Technical Journal, vol. 50, No. 10, Dec. 1971.

Bellanger, "Digital Filtering by Polyphase Network: Application to Sample-Rate Alternation and Filter Banks", IEEE Trans. on Acoustics, Speech, and Signal Processing, vol. ASSP-24, No. 2, Apr. 1976.

Rabiner, *Digital Processing of Speech Signals*, Bell Laboratories, 1978, p. 479.

Daly, "A Programmable Voice Digitzer Using the T.I. TMS-320 Microcomputer", IEEE International Conference on Acoustics, Speech and Signal Processing, 4/83, pp. 475-477.

*Primary Examiner*—Gary V. Harkcom
*Assistant Examiner*—John A. Merecki
*Attorney, Agent, or Firm*—Peter C. Van Der Sluys

[57] ABSTRACT

A polyphase digital filterbank extracts a spectral envelope composed of thirty-two bands, having uniform bandwidths, from a speech signal. The spectral envelope is then compressed into a predetermined number of bands having uniform bandwidths. Spectral energy features are extracted from the compressed envelope and are utilized to form templates representing the speech signal.

23 Claims, 11 Drawing Sheets

BASIC LOW PASS FILTER

FILTER B1: LP FILTER SHIFTED BY $f_{c1}$

FILTER B2: LP FILTER SHIFTED BY $f_{c2}$

APPARATUS FOR EXTRACTING FEATURES FROM A SPEECH SIGNAL

CROSS-REFERENCE TO RELATED APPLICATIONS

This application is related to one, or more, of the following U.S. patent applications: Ser. No. 659,989, U.S. Pat. No. 4,799,144 filed Oct. 12, 1984; Ser. No. 670,521 filed on Nov. 9, 1984. All of the above applications are assigned to the assignee hereof.

BACKGROUND OF THE INVENTION

The present invention generally relates to an apparatus for extracting features from a speech signal and, in particular, relates to one such apparatus that employs a polyphase digital filterbank for extracting a spectral envelope from a speech signal.

In the field of speech recognition and/or speaker verification as opposed to, for example, any revocalization of a spoken word, a relatively small number of features are required for the desired identification. However, in order to provide a reliable system, the extraction of those features must be accomplished accurately and consistently.

The accurate and consistent extraction of spectral features is, to a very large degree, dependent on a filterbank. That is, an analog speech signal representing a spoken word has an amplitude that changes with both frequency and time. Such a signal is sampled in both the time and frequency domains. The frequency domain samples, at each sampling time, contain the primary spectral features of interest. Thus, in order to extract such features, for each time sampled signal, the frequency domain signal is formed by filtering.

Until recently, filterbanks for speech recognition systems have been implemented using analog filter theory and technology. Analog filterbanks usually perform somewhat poorly. This poor performance is primarily due to the inherent limitations of analog components, i.e., analog components are inherently very difficult to reproduce with the accuracy necessary for speech recognition applications. In addition, the values of analog components inherently vary over time and are susceptible to such factors as temperature changes, surrounding radiation and the like. Thus, to provide an analog filterbank of acceptable quality, very precise, and correspondingly expensive, components must be used.

The relatively recent development of high speed digital signal processors has allowed the design and implementation of filterbanks based on digital filter theory and technology. The very nature of digital technology results in high performance digital filterbanks having exact response predictability. The performance of such digital filterbanks directly depends on the binary word length of the digital signal processor hardware used in the implementation thereof.

Nevertheless, it is not a straight forward task to design a high peformance digital filterbank. For example, using a conventionally designed digital filter, a modern digital signal processor operating at full capacity and conventional techniques provides a filterbank having a dynamic range of about 45 dB and a 14 band spectral envelope. Since the human voice has a dynamic range about 45 dB, such performance characteristics are barely adequate for a reasonably accurate speech recognition/speaker verification system. That is, the above performance characteristics would require a user to speak in a monotone to avoid loss of information. The number of bands extracted is directly related to the resolution of the filterbank. Thus, the more bands the greater the accuracy and consistency of the features extracted.

In addition to the general filterbank design difficulties, conventional speech recognition/speaker verification systems usually exhibit poor performance due to other difficulties. One difficulty results from the fact that filterbanks are composed of a set of nonoverlapping band pass filters, each having a finite transition band. Due to the somewhat periodic nature of a speech signal, the speech spectrum manifests a relatively strong fundamental pitch frequency. When this fundamental pitch frequency occurs between adjacent bands important spectral information is lost and the results become less accurate.

SUMMARY OF THE INVENTION

Accordingly, it is one object of the present invention to provide an apparatus for extracting features from a speech signal that exhibits an increased dynamic range.

This object is accomplished, at least in part, by an apparatus having a polyphase digital filterbank for extracting a spectral envelope from a speech signal such that the extracted spectral envelope is composed of a plurality of bands of the same bandwidth.

Other objects and advantages will become apparent to those skilled in the art from the following detailed description read in conjunction with the appended claims and the drawings attached hereto.

DETAILED DESCRIPTION OF THE INVENTION

Figure 1:
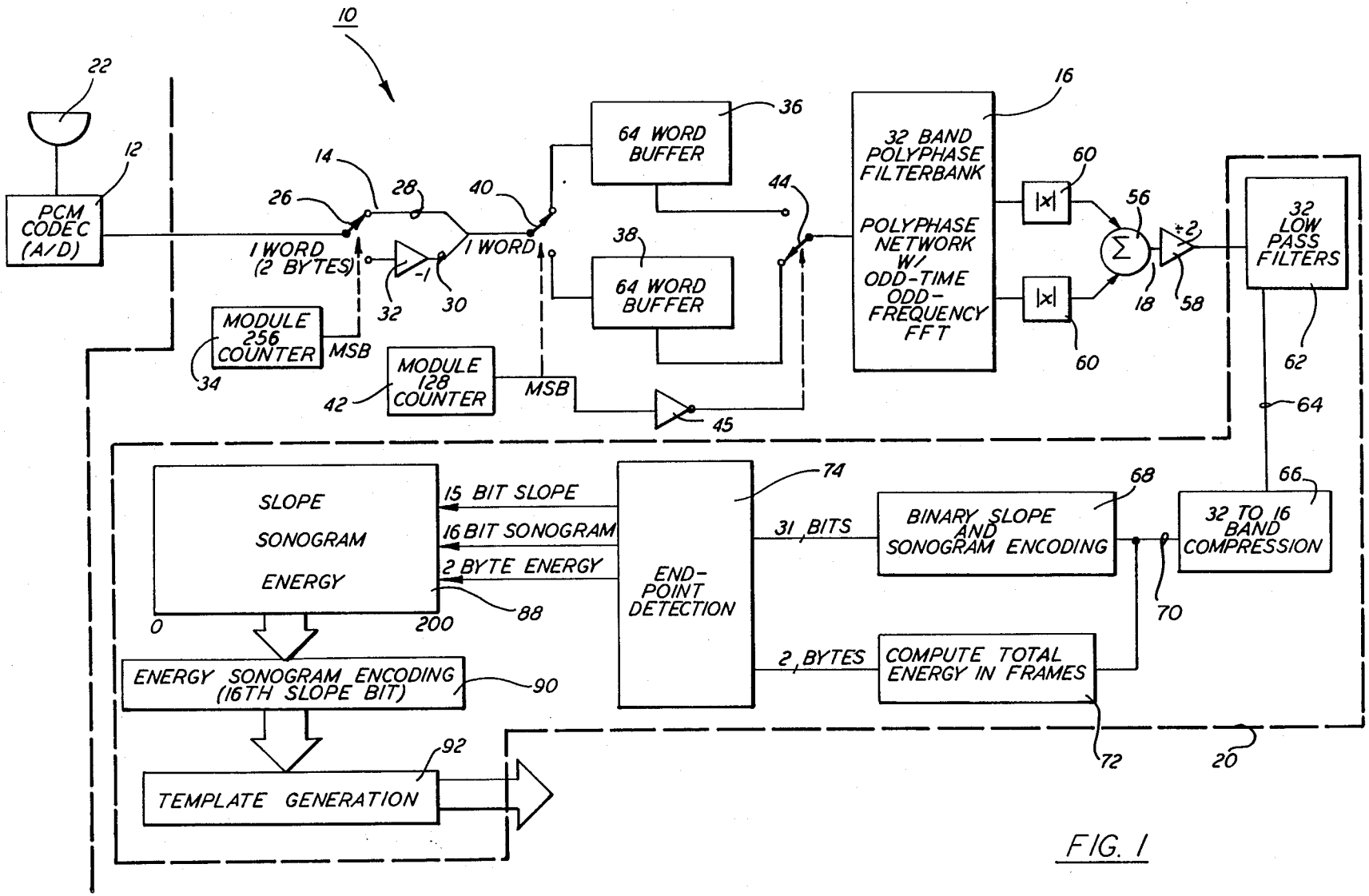
FIG. 1 is a block diagram of an apparatus for extracting features from a speech signal.

An apparatus, generally indicated at 10 in FIG. 1 and embodying the principles of the present invention, includes a means 12 for digitizing an analog speech signal, a means 14 for modulating the digitized speech signal, a means 16 for extracting a spectral envelope, a means 18 for time averaging the extracted spectral envelope and a means 20 for forming an utterance template from the time averaged data.

Figure 2:
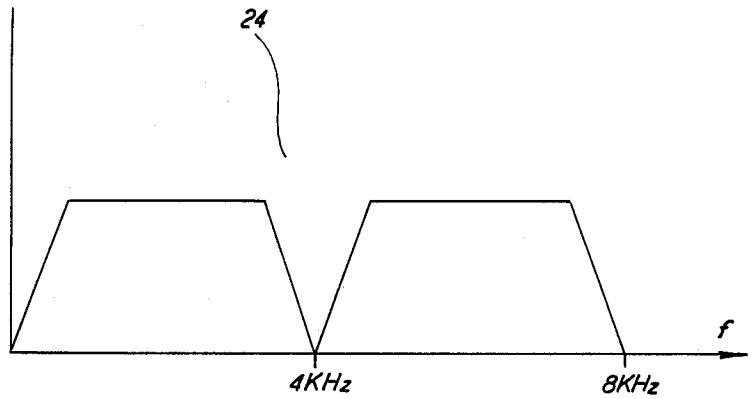
FIG. 2 is an input spectrum of a sampled speech signal.

In the preferred embodiment, a conventional microphone 22 converts a spoken word, or phrase, to an analog signal. The analog signal is inputted to the means 12 wherein the analog signal is digitized. Preferably, the means 12 includes a code/decode analog-to-digital converter that produces, as an output, a string of binary ones and zeros representative of the analog signal inputted thereto. The means 12, preferably includes a bandpass filter having a passband frequency from 0 to 4 kiloHertz as it is within this frequency band that substantially all information is contained in a human voice. The output spectrum 24 of the means 12, in the frequency domain, is shown in FIG. 2. As shown, the signal of interest lies between 0–4 KHz although the sampled output spectrum inherently repeats every 4 KHz. In one specific example, the means 12 is implemented by use of a M7901 device manufactured and marketed by Advanced Micro Devices Corp. of Sunnyvale, Calif.

The means 14 for modulating the digitized speech signal substantially reduces any loss of spectral data due to the finite transition band of the filters within the filterbank. As previously mentioned, due to the quasi-periodic nature of the speech signal, the spectrum of voiced speech exhibits a strong fundamental pitch frequency. If this frequency lies between adjacent bands, i.e., where the finite transition band occurs, substantial spectral data is lost. By smearing the digitized signal, the energy content at that fundamental pitch frequency is expanded and thus becomes discernable by at least one of the adjacent filters.

Preferably, because of the ease of implementation, the modulation is a low frequency square wave, although other forms of modulation can also be used. In one implementation, as shown in FIG. 1, every other group of 128 bits from the means 12 is sign inverted. Specifically, the means 14 includes a first switching means 26 adapted to direct the output from the means 12 either through a first path 28 or a second path 30, the second path 30 being parallel to the first path 28 and including a negator 32 serially located therein. The first switching means 26 is adapted to switch between the first and second paths, 28 and 30 respectively, after every 128 bits are counted by a path counter 34.

The output from the first and second paths, 28 and 30 respectively, is directed into either a first buffer 36 or a second buffer 38 by a second switching means 40. Preferably, the second switching means 40 alternately connects the output from the first and second paths, 28 and 30 respectively, to a different one of the buffers, 36 or 38, after each sixty-four bits, as counted by a buffer counter 42. The buffer counter 42 additionally controls the position of a third switching means 44 that connects, depending on the position thereof, one of the buffers, 36 or 38, to the means 16. As shown, the second and third switching means, 40 and 44 respectively, are arranged such that when bits are being stored in one of the buffers, for example, the first buffer 36, the second buffer 38 is supplying data to the means 16. This control is achieved, in one embodiment, by means of an inverter 45 between the counter 42 and the third switching means 44. Thus, when the output from the counter 42 is a binary value and the switching means, 40 and 44, switch when there is a change in that binary value, the inverter 45 ensures that the switching means, 40 and 44 are opposed.

Figure 3:
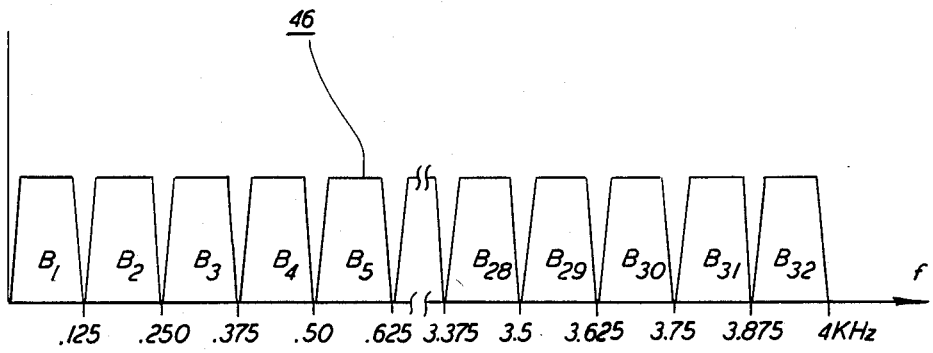
FIG. 3 is a composite frequency response of the polyphase digital filterbank shown in FIG. 1.

In the present apparatus 10, the means 16 is a polyphase digital filterbank that, unlike conventional filterbanks, effectively divides the input signal thereto into a plurality of bands 46 of equal bandwidth. In the preferred embodiment, thirty-two such bands 46, as shown in FIG. 3, are extracted, each band having a bandwidth of 125 Hz.

Polyphase digital filterbanks, per se, are known in the art, see, for example, DIGITAL FILTERING BY POLYPHASE NETWORK: APPLICATION TO SAMPLE-RATE ALTERATION AND FILTER BANKS; *IEEE Transactions on Acoustics, Speech and Signal Processing;* Vol. ASSP-24, No. 2, April 1976, Pgs. 109–114 by Bellanger et al; DIGITAL PROCESSING TECHNIQUES IN THE 60 CHANNEL TRANSMULTIPLEXER; *IEEE Transactions on Communications,* Vol. Com-26, No. 5, May 1978, Pgs. 698–706, Bonnerot et al; and the article entitled ODD-TIME ODD-FREQUENCY DISCRETE FOURIER TRANSFORM FOR SYMMETRIC REAL-VALUED SERIES; *Proceedings of the IEEE,* March 1976, Pgs. 392–393 by Bonnerot and Bellanger. The above referenced articles are, for the teaching of a polyphase digital filterbank and the use thereof with a Fourier Transform, hereby deemed incorporated herein by reference.

Figure 4:
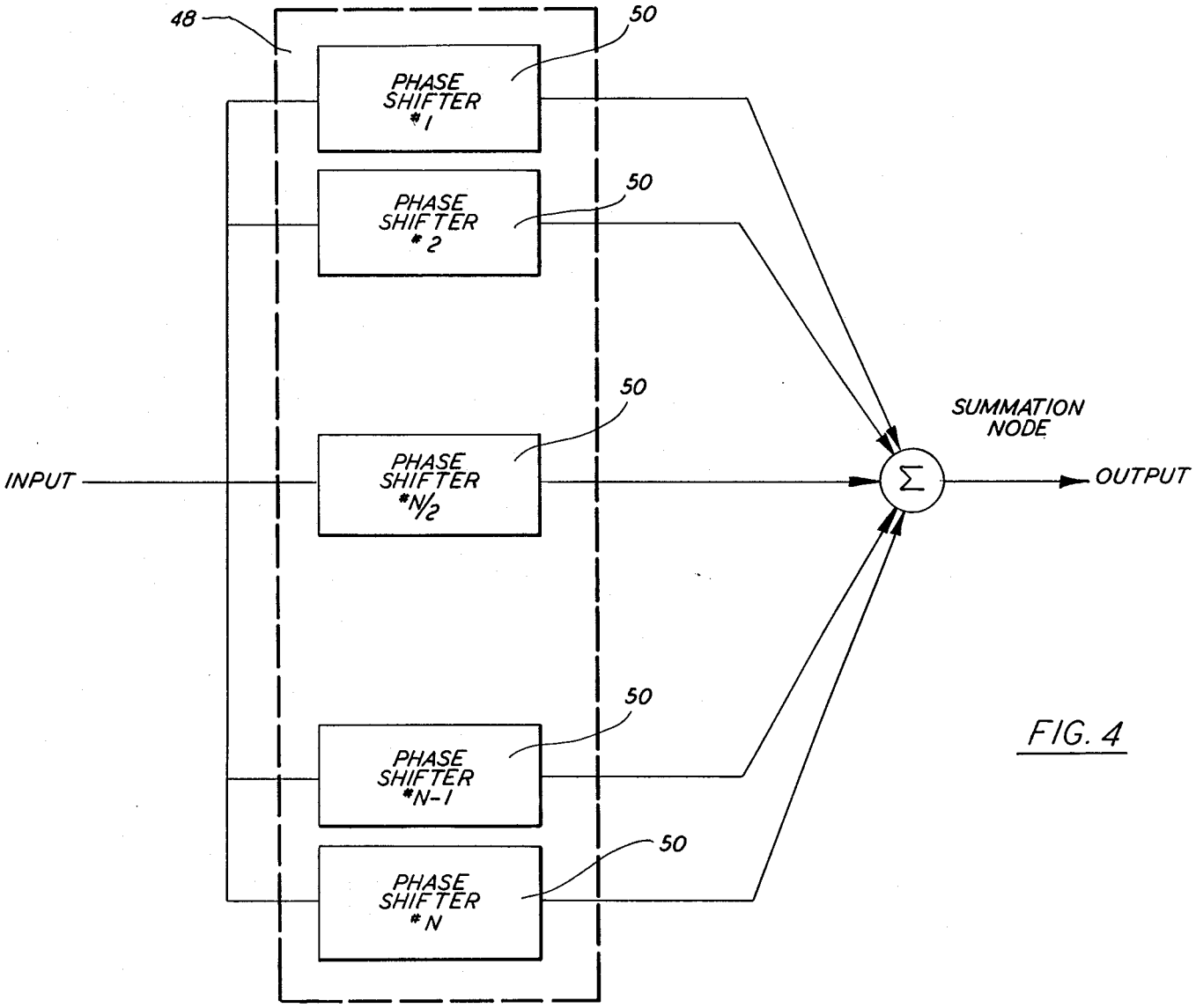
FIG. 4 is a block diagram of a basic polyphase digital filter.

Referring now to FIG. 4 a filter 48 in the form of an all pass phase shifting network having a plurality of phase shift elements 50 in parallel is depicted. The input is provided to all of the phase shifters 50 and, as such, no data is rejected, i.e. lost, and there are no significant gain differences between adjacent filters. Thus, a greater dynamic range is achieved since the limitations normally incurred to avoid saturation of a particular filter are removed. This is, in conventional filterbanks the overall dynamic range is restricted to avoid the introduction of excessive gain swings between adjacent bandpass filters. Thus, by eliminating the possibility of such gain variations, the dyanmic range of each filter is increased.

Figure 5:
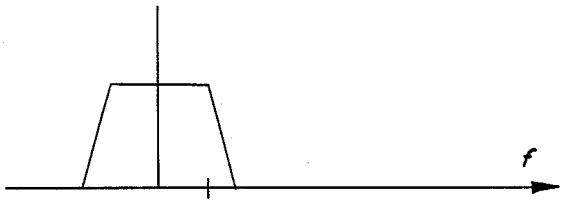
FIG. 5 is a graphic representation of how a low pass filter is modulated to form a band pass filter.
Figure 5:
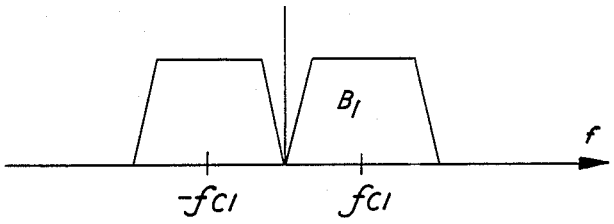
Figure 5:
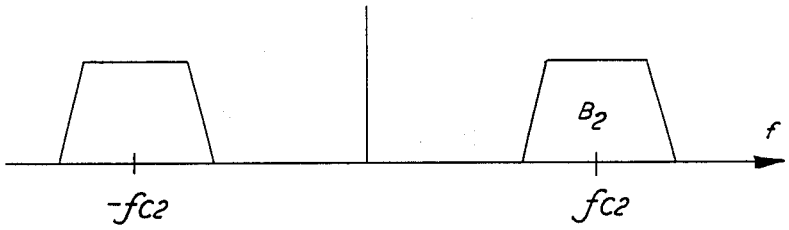

The filter 48 shown in FIG. 4 effectively generates the basic low pass filter response of FIG. 5. A pair of complex frequency shifted responses as shown in FIG. 5 can be generated by frequency shifting this filter twice. Consequently, in order to effect a thirty-two band filter a total of sixty-four filters must be generated to compensate for the positive and negative frequency shifts. As a result, the filter 48 shown in FIG. 4 must be adapted to effect sixty-four phase shifters.

Figure 6:
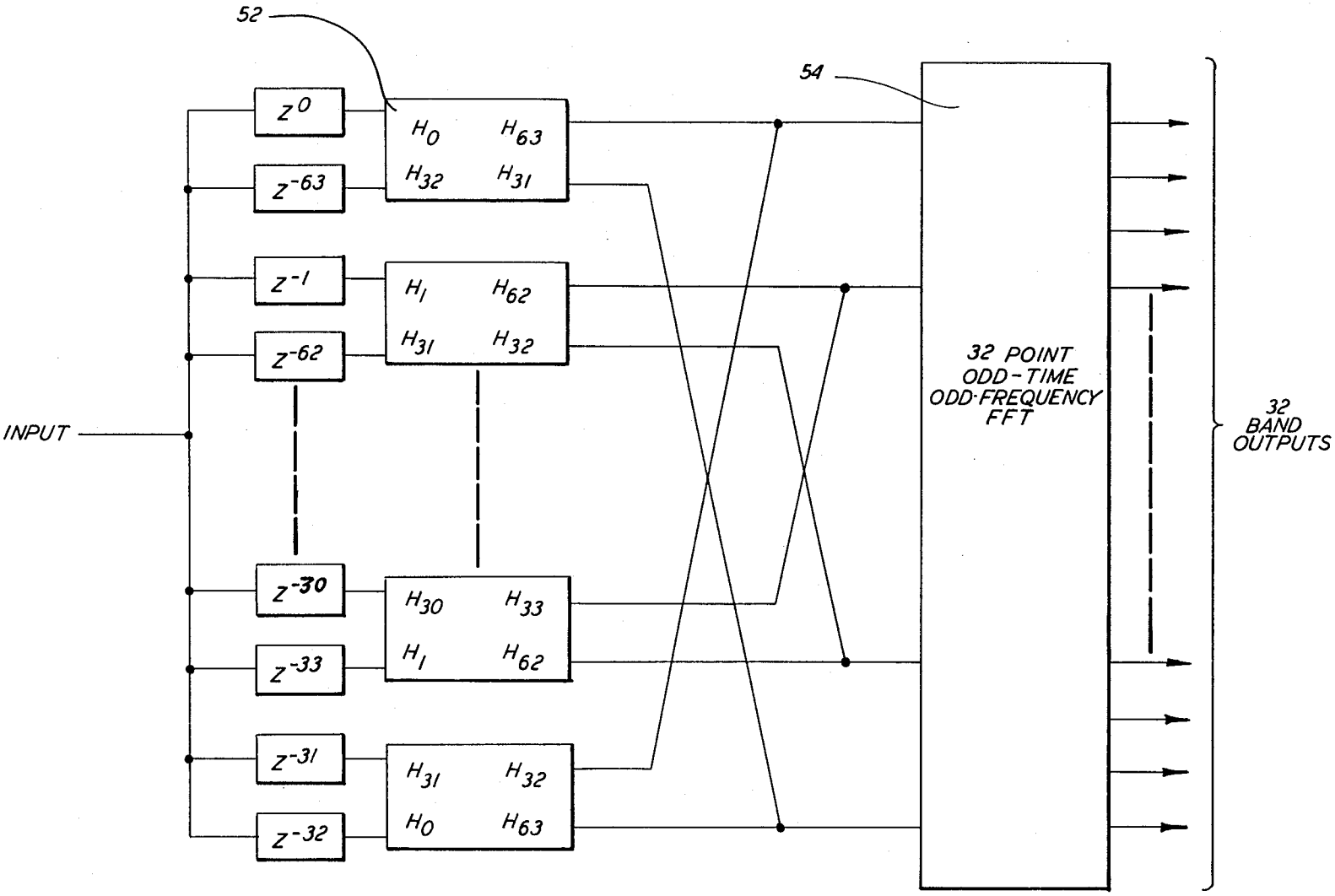
FIG. 6 is a block diagram of a preferred polyphase digital filterbank.

Following the mathematical derivation as set forth in Bellanger et al. the coefficients for the model polyphase digital filterbank 52, as shown in FIG. 6, are derived. Such a model, employing an odd-time odd-frequency Fourier transformer 54, is described in FIG. 6 of the Bonnerot et al. reference.

As the theory and derivation of the means 16 is fully described in the above-cited references, further discussion of the intricate details thereof is deemed unnecessary herein. Nevertheless, the primary benefits of a polyphase digital filterbank are significant in the fields of voice recognition and speaker discrimination. For example, a substantially increased dynamic range, i.e. in excess of 78 dB; a filter of the sixth order and the reduction in real computational steps, i.e. by a factor of thirty-two.

As a consequence, the means 16, in the preferred embodiment, can be implemented, for example, on a TMS320, manufactured and marketed by Texas Instruments of Dallas, Tex., requiring only about 20% of the available computational capacity and time thereof. One preferred program for such an implementation is provided in Appendix A. As a result, the remaining 80% of the computational capacity and time is available for tasks, such as template generation, conventionally delegated to other devices.

The output of the filterbank is a spectral envelope composed of thirty-one bands of odd samples and thirty-two bands of even samples which, after taking the absolute value, via means 60, thereof yields an instantaneous energy estimate for each of the thirty-two frequency bands from 0 to 4 kHz every 4 milliseconds. However, a slower short time average of the spectrum has been found sufficient for voice recognition purposes. Hence, the means 18 for time averaging the extracted spectral data is provided and includes a summing means 56 that sums the odd and even samples of each of the thirty-two bands. The output for the summing means 56 is next divided by two by a conventional divider to provide the short time average.

Figure 7:
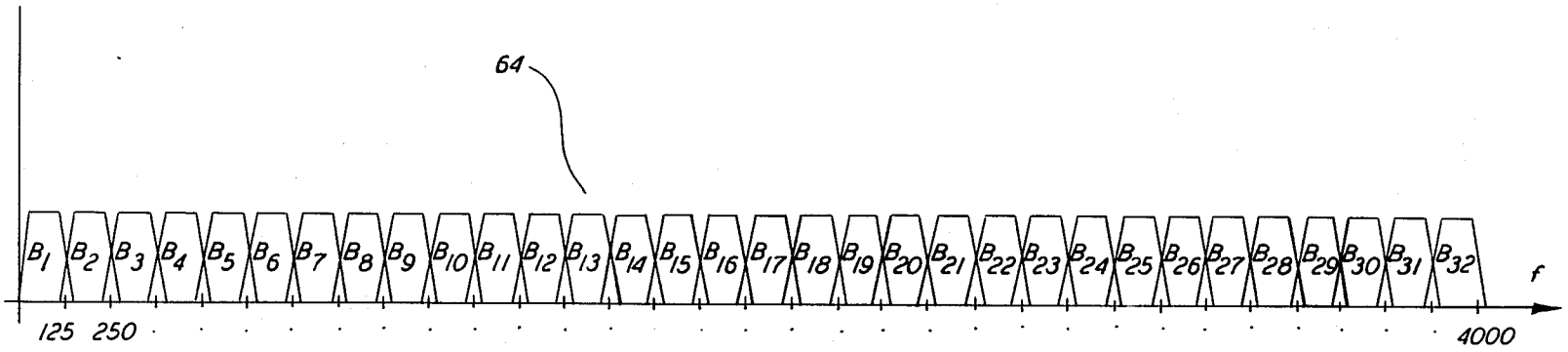
FIG. 7 is a graphic representation of the response of the filter shown in FIG. 6.

The output of the divider 58 is inputted to a first order recursive filter 62 to determine the sampled energy of the band. The output of the filter 62, as shown in FIG. 7, is a time smoothed spectral envelope 64 having a frequency resolution of 125 Hz and a time sample spacing of 8 milliseconds.

The voice recognition, the information of interest contained in the spectral envelope lies not so much in the actual spectral energy of the bands but more in the variations thereof in time and frequency. Thus, the means 20 includes a means 66 for band compression, a means 68 for the binary encoding of the differential frequency change between adjacent bands and for binary encoding the energy variation with frequency. The extraction of essential features as performed herein effectively compresses the total information for a speech signal to a relatively fewer number of data to allow efficient storage thereof.

Figure 8:
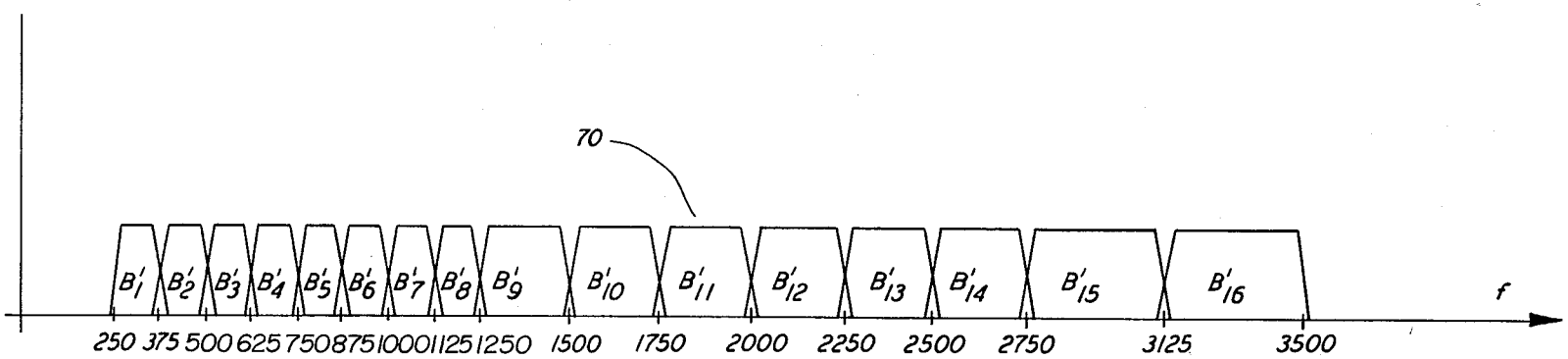
FIG. 8 is a graphic representation of a band compressed response of the filter shown in FIG. 6.

The means 66 for band compression, in the preferred embodiment, reduces the number of bands from thirty-two to sixteen. By conventional digital logic, the effective energy content of the thirty-two bands is combined into the sixteen resultant bands, shown in FIG. 8. In the preferred embodiment, the essential rules for this compression are that the lowest two bands and the four highest bands are discarded since the human voice produces very little energy in these frequency ranges. The third through tenth bands, see FIG. 7, are retained without modification since the energy within this frequency range contains the primary characterization features. The remaining bands, i.e., bands eleven through twenty-eighth, are merged as shown in FIG. 8 since the information content in each band decreases with increasing frequency. As a consequence, the original thirty-two bands of equal bandwidth are reduced to sixteen bands having non-uniform bandwidths.

Figure 9:
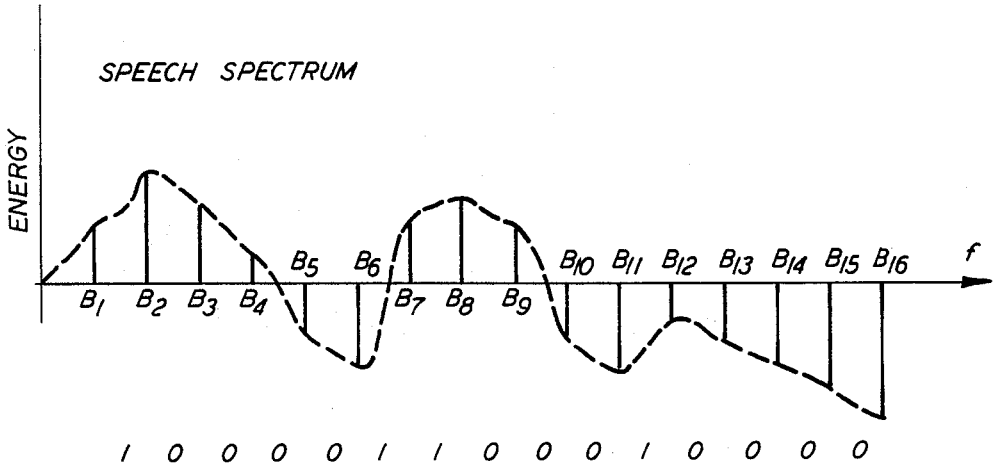
FIG. 9 is a graphic representation of a first binary encoding.

The means 68 for binary slope encoding is, effectively, a subtractor that outputs a binary value depending upon the direction of the differential change in energy between adjacent bands. As shown in FIG. 9, the energy bands, although represented as being of equal bandwidth are, in fact, of non-uniform bandwidth as previously discussed and the dotted envelope is represented by the binary numbers indicative of the slope direction between adjacent bands.

Figure 10:
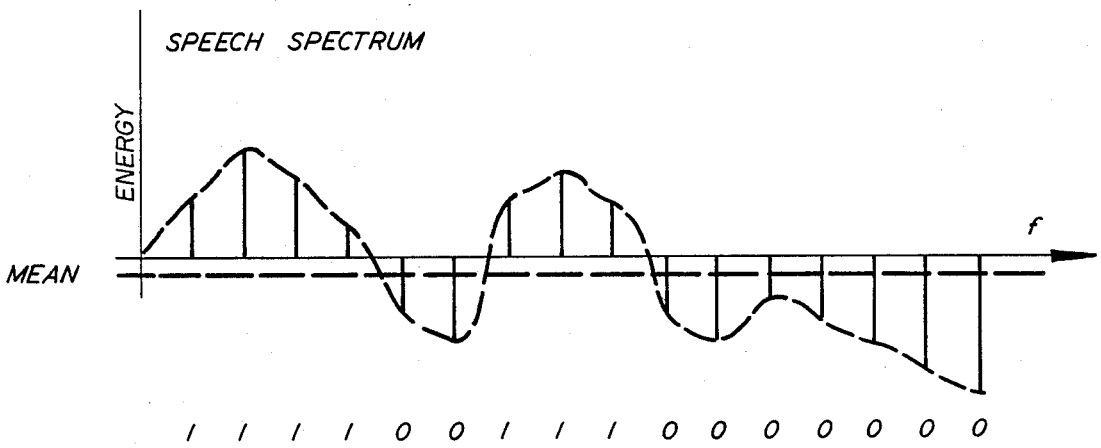
FIG. 10 is a graphic representation of a second binary encoding.

Similarly, the sonogram is encoded via a combination averaging device and a subtractor that outputs a binary value depending on whether the energy content of a particular band is greater or less than the mean energy of all sixteen bands. For example, referring to FIG. 10, the mean energy is shown in a dotted horizontal line with the spectrum envelope in an envelope dashed outline. As shown, the binary values for each band are indicative of the relative energy of each band with respect to the mean. If the energy is greater than the mean, a binary one is encoded. If the energy is less, then a binary zero is encoded.

Thus the output of the means 68 for generating a binary slope and encoding the sonogram together is represented by thirty-one bits of information, i.e., fifteen bits of slope data (only fifteen bits are encoded since the differential between the actual bands is being measured) and sixteen bits of sonogram data.

In addition, a summer 72 perceives the total energy contained in the sixteen bands remaining after the band compression to provide two bytes of information representative of the total energy in the compressed bands. The output from the total energy summer 72 and the binary encoding means 68 are inputted to an end point detector 74.

Preferably, the end point detection 74 is a microprocessor based device using generally accepted algorithms and determines the existence of a word based on the following assumptions regarding the spoken word:

1. It is assumed that a spoken word will have an energy level greater than some particular threshold energy. In this instance, the threshold energy, which is an empirically determined value based on a comparison between energy differences during silence and speech, is compared to the two bytes of information previously discussed;

2. The spoken word has a minimum duration below which any data received is considered line noise. In addition, a spoken word is expected to have a maximum duration, in this embodiment, a maximum length of approximately two seconds is assumed.

Figure 12:
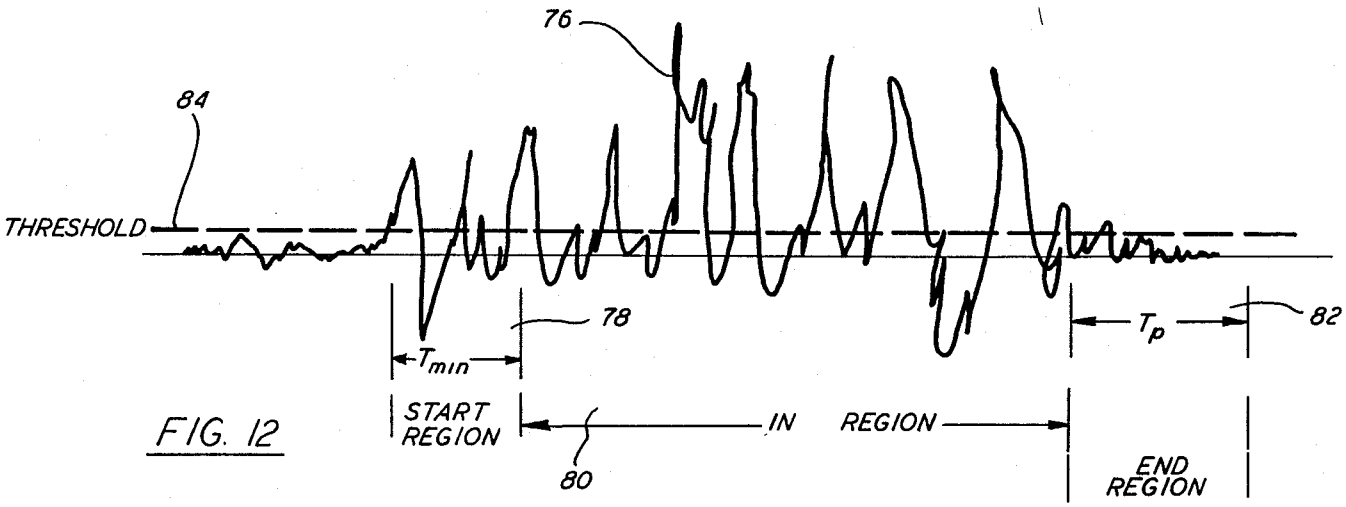
FIG. 12 is a graphic representation of factors used for word detection.
Figure 11:
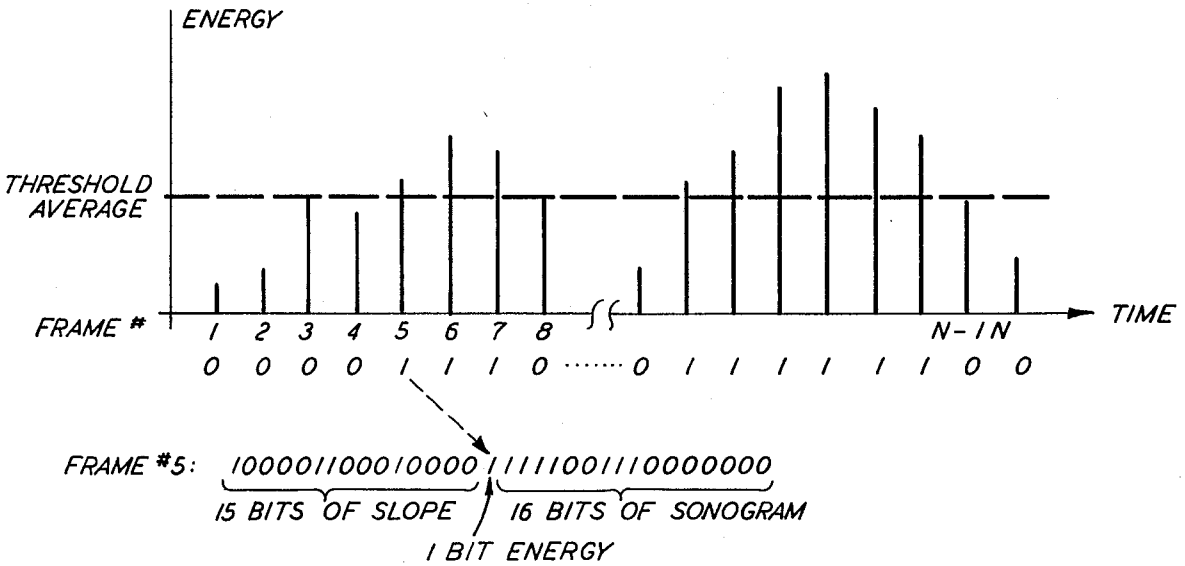
FIG. 11 is a graphic representation of a third binary encoding.

It is further assumed that there will be no pause during any word greater than about 150 milliseconds. Based on these assumptions, a speech, or utterance, signal 76 can be broken down as shown in FIG. 12. As shown, the actual word, or information of interest, includes a "start" region 78, an "in" region 80, where the word is actually being spoken, and an "end" region 82 where the energy tapers off below a certain predetermined threshold 84.

Figure 13:
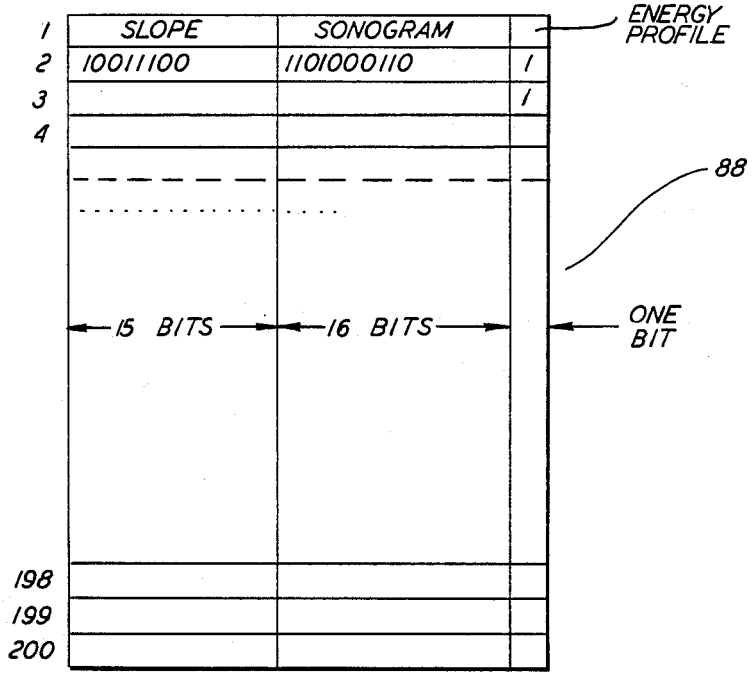
FIG. 13 is a block diagram of a framed word.
Figure 14:
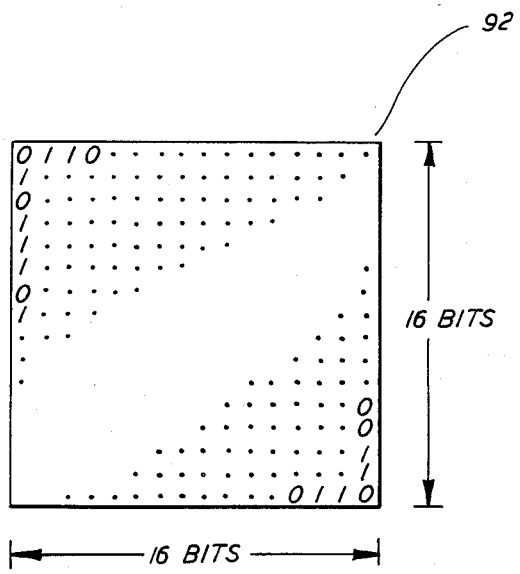
FIG. 14 is a block diagram of an utterance template.
Figure 15:
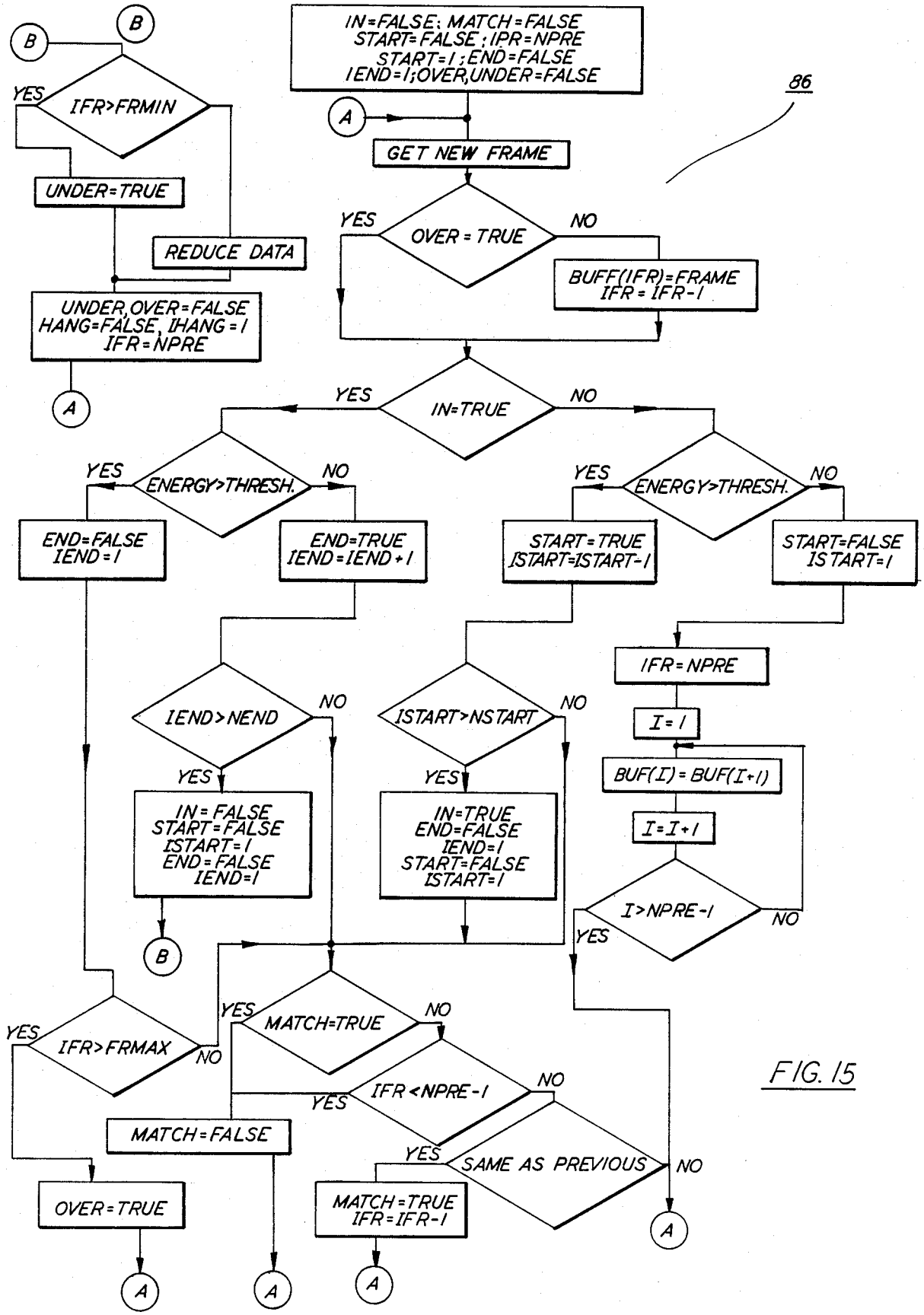
FIG. 15 is a flow chart of a method for generating the utterance template shown in FIG. 14.

A flow chart 86 indicating a procedure used in determining the presence or absence of a word from the binary data is shown in FIG. 15. The decision to be made as each group of thirty-one bits of data plus energy information is passed or manipulated by the algorithm is whether or not to deliver that information to a frame buffer 88 such as the one shown in FIG. 13. So long as the conditions for the existence or presence of a word exists, all binary encoded information is stored in the frame buffer 88 that, as shown, is effectively thirty-two bits wide and having the first fifteen bits representative of the slope information, and the second sixteen bits of information representing being the sonogram data. In addition, the total energy is characterized and determined to be relatively positioned with respect to the overall energy of a particular word. If the energy of a given word is greater than the average energy, a binary bit is encoded in the sixteenth position of the slope string by energy encoding means 90. This provides an additional piece of data in the determination of a subsequently entered utterance template. As shown in FIG. 13, the frame buffer 88 in the preferred embodiment, can contain up to 200 samples of slope, sonogram and energy profile data. That is, if the speech signal represents a long, for example about 2 seconds, word the data storage nevertheless ceases after 200 samples. It has been determined that this is sufficient to identify even a relatively long word.

When the end point of a word is determined, the total frame buffer 88 is further compressed to fit a template 92, i.e. an array, having a predetermined size which, in the preferred embodiment, is effectively a 16×16 bit array containing 256 bits of spectral data. In order to accomplish this, after the data has been entered into the frame buffer 88 it is compressed based on the following rule that eliminates a frame if it is identical to the previous frame providing that there is no elimination of any two consecutive frames. To reduce the data stored in the frame buffer 90 to the preselected number of bits in the template 92, i.e., thirty-two bytes, the number of frames in the buffer 90 is first divided by eight and rounded down to the nearest integer N. Thus, eight composite frames are generated by taking a majority polling of each bit position in each group of N frames. The result is that every template 92 generated consists of 256 bits. The template 92 so generated is passed to a storage medium, not shown in the drawing, for subsequent use in the scoring against an unknown utterance template. One such scoring scheme is fully described in co-pending U.S. patent application Ser. No. 670,521 filed on even date herewith and assigned to the assignee hereof.

Figure 16:
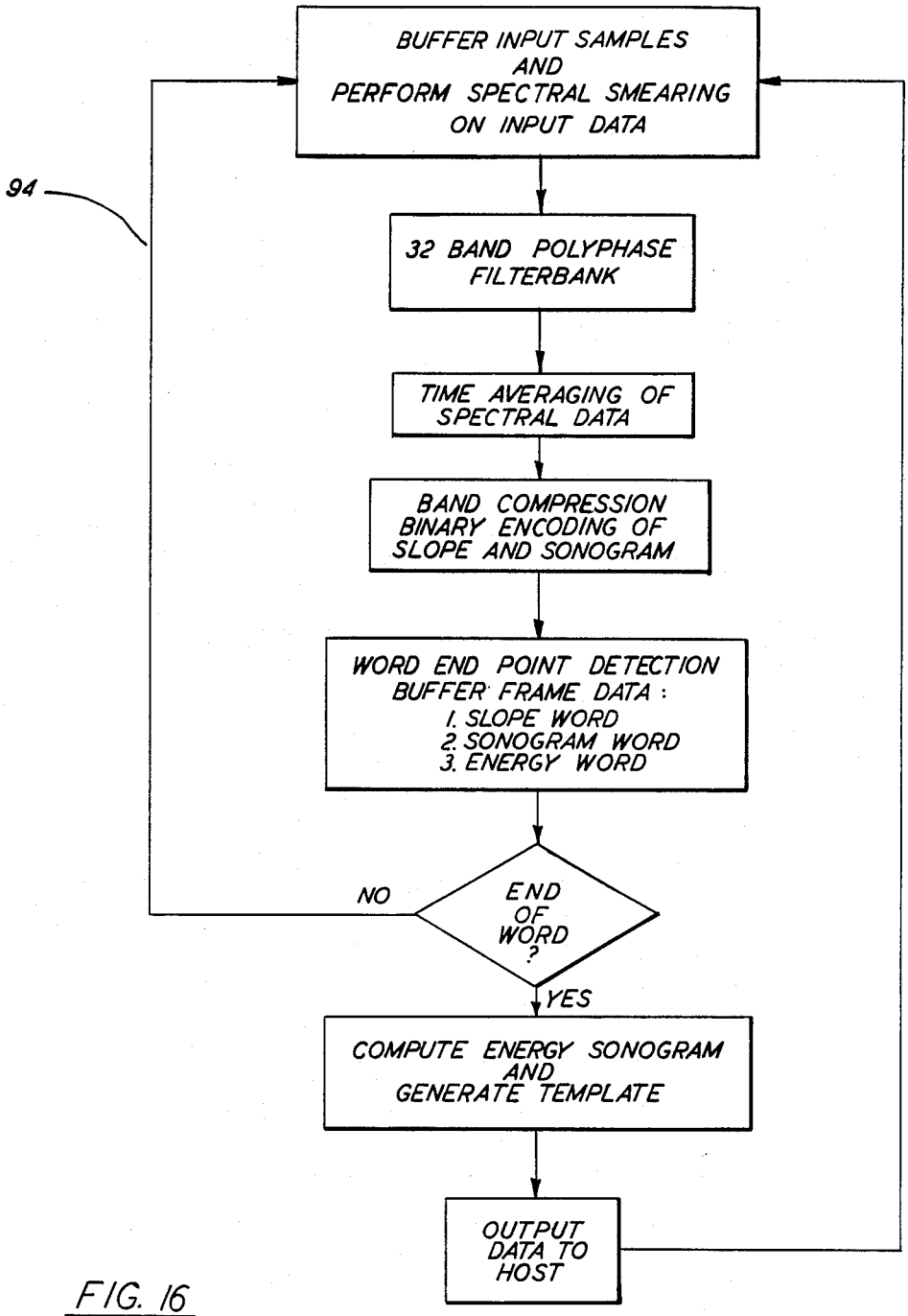
FIG. 16 is a flow diagram of the method used with the apparatus shown in FIG. 1 for extracting features from a speech signal.

The use of the above-described apparatus 10 is enhanced by, and incorporates a method for forming or generating utterance templates. Referring to FIG. 16, a flow diagram 94 is shown depicting the steps of the preferred method for generating utterance templates. As shown, the input is first buffered and then spectrally smeared. The spectrally smeared data is then filtered, preferably by a polyphase digital filterbank, and the output thereof is time averaged. Subsequent to the time averaging, the data is compressed, binarily encoded and examined to ascertain the presence or absence of a spoken word. Upon determining the presence of a spoken word, the data is buffered and further compressed whereafter the compressed data is stored in an utterance template having a prespecified and uniform size regardless of the word spoken.

The apparatus and method discussed herein provides numerous advantages unavailable via conventional voice recognition template generating mechanisms. For example, the extracted spectral envelope has a significantly improved filter response as well as an increased overall dynamic range, i.e., 6th order filters are used. In addition, the use of spectral smearing significantly reduces the possibility of losing important information due to the particular pitch frequency of a speaker. Further, the utterance template 92 generated not only is of a prespecified size for all words, but also contains information relating to the total energy of the particular spoken word represented by the template. Yet another advantage, directly resultant from the use of a digital polyphase filterbank, is that the entire utterance template generation can be executed on a single conventional digital signal processor device since, by use of such a filterbank, the mathematical computations required to extract the spectral envelope are significantly reduced.

Although the present invention has been described herein using a specific exemplary embodiment, other configurations or arrangements may also be developed that do not depart from the spirit and scope of the present invention. Consequently, the present invention is deemed limited only by the appended claims and the reasonable interpretation thereof.

```
0001
0002          *
0003          *
0004          *
0005          *
0006          *
0007          *
0008          *
0009          *
0010          *
0011          *
0012          *
0013          *
0014          *
0015          *
0016          *
0017          *
0018          *
0019          *
0020          *
0021          *
0022          *
0023          *
0024          *
0025          *
0026          ***************************************************
0027          *
0028          *     THIS PROGRAM TAKES IN SAMPLES AT AN 8KHZ
0029          *     RATE (ON INTERRUPT FROM CODEC). THIS DATA
0030          *     IS DECIMATED BY A FACTOR OF 32, FILTERED
```

```
0031            *       BY A 32 BAND POLYPHASE FILTER,AND
0032            *       STORED
0033            *
0034            ***********************************************
0035            *
0036            *
0037            *       *********DEFINE I/O PORT***********
0038            *
0039            *
0040      0000  IN88    EQU     00        * INPUT PORT FROM 8088.
0041      0000  OUT88   EQU     00        * OUTPUT PORT TO 8088.
0042      0001  PCMIN   EQU     01        * INPUT PORT FROM CODEC.
0043      0001  PCMOUT  EQU     01        * OUTPUT PORT TO CODEC.
0044            *
0045            *
0046            *       *********DEFINE DATA RAM***********
0047            *
0048            *
0049            *
0050      0000  SO01    EQU     00        \
0051      0001  SO02    EQU     01        |
0052      0002  SO03    EQU     02        |
0053      0003  SO04    EQU     03        |
0054      0004  SO05    EQU     04        |
0055      0005  SO06    EQU     05        |
0056      0006  SO07    EQU     06        |
0057      0007  SO08    EQU     07        |
0058      0008  SO09    EQU     08        |
0059      0009  SO10    EQU     09        |
0060      000A  SO11    EQU     10        |
0061      000B  SO12    EQU     11        |
0062      000C  SO13    EQU     12        |
0063      000D  SO14    EQU     13        |
0064      000E  SO15    EQU     14        |
0065      000F  SO16    EQU     15         >  ODD MODULE OUTPUT RESULTS
0066      0010  SO17    EQU     16        |
0067      0011  SO18    EQU     17        |
0068      0012  SO19    EQU     18        |
0069      0013  SO20    EQU     19        |
0070      0014  SO21    EQU     20        |
0071      0015  SO22    EQU     21        |
0072      0016  SO23    EQU     22        |
0073      0017  SO24    EQU     23        |
0074      0018  SO25    EQU     24        |
0075      0019  SO26    EQU     25        |
0076      001A  SO27    EQU     26        |
0077      001B  SO28    EQU     27        |
0078      001C  SO29    EQU     28        |
0079      001D  SO30    EQU     29        |
0080      001E  SO31    EQU     30        |
0081      001F  SO32    EQU     31        /
0082      0020  SE01    EQU     32        \
0083      0021  SE02    EQU     33        |
0084      0022  SE03    EQU     34        |
0085      0023  SE04    EQU     35        |
0086      0024  SE05    EQU     36        |
0087      0025  SE06    EQU     37        |
0088      0026  SE07    EQU     38        |
0089      0027  SE08    EQU     39        |
0090      0028  SE09    EQU     40        |
0091      0029  SE10    EQU     41        |
0092      002A  SE11    EQU     42        |
0093      002B  SE12    EQU     43        |
0094      002C  SE13    EQU     44        |
0095      002D  SE14    EQU     45        |
0096      002E  SE15    EQU     46         >  EVEN MODULE OUTPUT RESULTS
0097      002F  SE16    EQU     47        |   (share memory with MODULE)
0098      0030  SE17    EQU     48        |
0099      0031  SE18    EQU     49        |
0100      0032  SE19    EQU     50        |
0101      0033  SE20    EQU     51        |
0102      0034  SE21    EQU     52        |
0103      0035  SE22    EQU     53        |
0104      0036  SE23    EQU     54        |
0105      0037  SE24    EQU     55        |
0106      0038  SE25    EQU     56        |
0107      0039  SE26    EQU     57        |
0108      003A  SE27    EQU     58        |
0109      003B  SE28    EQU     59        |
```

```
0110   003C  SE29   EQU   60   |
0111   003D  SE30   EQU   61   |
0112   003E  SE31   EQU   62   |
0113   003F  SE32   EQU   63   /
0114         *
0115   0040  A0     EQU   64   \-----------------------------\
0116   0041  A1     EQU   65   |                             |
0117   0042  A2     EQU   66   |                             |
0118   0043  A3     EQU   67    > MODULE FIR COEFFICIENTS    |
0119   0044  B0     EQU   68   |                             |
0120   0045  B1     EQU   69   |                             |
0121   0046  B2     EQU   70   |                             |
0122   0047  B3     EQU   71   /                             |   OVERLAID BY
0123   0048  Z20    EQU   72   \                             > MODULE BUFFER
0124   0049  Z21    EQU   73   |                             |   IN PRAM!
0125   004A  Z22    EQU   74   |                             |
0126   004B  Z23    EQU   75   |                             |
0127   004C  Z10    EQU   76    > MODULE SAMPLE DELAY VALUES |
0128   004D  Z11    EQU   77   |                             |
0129   004E  Z12    EQU   78   |                             |
0130   004F  Z13    EQU   79   |-----------------------------/
0131   0050  Z14    EQU   80   /
0132   0051  X1     EQU   81   \   NEW INPUTS TO MODULE
0133   0052  XN     EQU   82   /
0134         *
0135   0053  MEM01  EQU   83   \
0136   0054  MEM02  EQU   84   |
0137   0055  MEM03  EQU   85   |
0138   0056  MEM04  EQU   86   |
0139   0057  MEM05  EQU   87   |
0140   0058  MEM06  EQU   88   |
0141   0059  MEM07  EQU   89   |
0142   005A  MEM08  EQU   90    >      * MEMORY STORAGE FOR FRAME IIR FILTER
0143   005B  MEM09  EQU   91   |         ROUTINE: FFILTR.
0144   005C  MEM10  EQU   92   |
0145   005D  MEM11  EQU   93   |
0146   005E  MEM12  EQU   94   |
0147   005F  MEM13  EQU   95   |
0148   0060  MEM14  EQU   96   |
0149   0061  MEM15  EQU   97   |
0150   0062  MEM16  EQU   98   /
0151         *
0152   0063  CC0    EQU   99      CONTAINS DEN. COEF. C0.
0153   0064  CC1    EQU   100     CONTAINS DEN. COEF. C1.
0154   0065  CC2    EQU   101     CONTAINS DEN. COEF. C2.
0155   0066  BUF1   EQU   102     CONTAINS INPUT BUFFER #1 PRAM ADDRESS + 1
0156   0067  BUF2   EQU   103     CONTAINS INPUT BUFFER #2 PRAM ADDRESS + 1
0157   0068  MODDEL EQU   104     CONTAINS PRAM ADDRESS OF THE MODULE DELAY AND
0158         *                            COEFFICIENT DATA.
0159         *
0160   0069  BUFFUL EQU   105     FLAG SET BY INTSRV ROUTINE WHEN INPUT BUFFER
0161         *
0162   006A  INBUF  EQU   106     INBUF POINTS TO BOTTOM OF CURRENT INPUT BUFFER
0163         *                            PRAM, USED IN INTERRUPT SERVICE ROUTINE.
0164   006B  SIGN   EQU   107     SIGN MULTIPLIER USED IN INTERRUPT ROUTINE.
0165         *
0166   006C  OUTBUF EQU   108     OUTBUF POINTS TO BOTTOM OF CURRENT OUTPUT BUF
0167         *                            IN PRAM, USED IN MODULE ROUTINE.
0168   006D  INCNT  EQU   109     INCNT CONTAINS CURRENT SAMPLE COUNT(64-1) IN I
0169   006E  MODCNT EQU   110     MODCNT CONTAINS CURRENT MODULE NUMBER(1-32).
0170   006F  CNTMOD EQU   111     CNTMOD=64-MODCNT + 1 ie.(64-33)
0171   0070  SOCNT  EQU   112     ODD MODULE RESULT COUNTER.
0172   0071  SECNT  EQU   113     EVEN MODULE RESULT COUNTER.
0173   0072  INTEMP EQU   114     INPUT TEMP STORAGE.
0174         *
0175   0073  NUM31  EQU   115     CONSTANT 31.
0176         *
0177   0074  ONE    EQU   116     CONSTANT 1.
0178         *
0179   0075  NEGONE EQU   117     CONSTANT -1.
0180         *
0181   0040  BTEMP  EQU   64      BUTTERFLY TEMP STORAGE.
0182         *
0183         * *****DEFINE DATA MEMORY LOCATIONS FOR TEMPLATE GENERATION
0184         *
0185         *        ***TEMPORARY STORAGE LOCATIONS***
0186         *
0187   0010  ENERGL EQU   16      LOW BYTE OF ENERGY SUMMATION.
0188   0011  ENERGH EQU   17      HIGH BYTE OF ENERGY SUMMATION.
```

```
0012  SLOPE   EQU   18      SLOPE ENCODED FRAME WORD.
0013  MEAN    EQU   19      AVERAGE ENERGY ACROSS BANDS IN A FRAME.
0014  SONO    EQU   20      SONOGRAM ENCODED FRAME WORD.
0015  SLPTMP  EQU   21      TEMP. SLOPE BUFFER.
0016  SONTMP  EQU   22      TEMP. SONOGRAM BUFFER.
0017  MSIZE   EQU   23      NUMBER OF SAMPLES PER BLOCK (IFRAME/8)
0018  M2SIZE  EQU   24      MSIZE/2
0019  LL1     EQU   25      SLOPE BUFFER POINTER.
001A  LL2     EQU   26      LONOGRAM BUFFER POINTER.
001B  L1      EQU   27      SLOPE BIT CNT.
001C  L2      EQU   28      SONOGRAM BIT CNT.
001D  BLKCNT  EQU   29      BLOCK LOOP COUNTER.
      *
001E  TMPBUF  EQU   30
      *               |   \
      *               |   |
      *               |   |
      *                    >  TEMPLATE BUFFER (16 WORDS:8 SLOPE, 8 SONGRAM.)
      *               |   |
      *               |   |
      *               45  /
      *
002E  TMPLET  EQU   46      CONTAINS THE ADDRESS OF PRESENT TEMPLATE
002F  BITCNT  EQU   47      BIT COUNT LOOP COUNTER.
0030  RMASK   EQU   48      BIT MASK.
0031  LOOPCT  EQU   49      TEMPLATE LOOP COUNTER.
0032  SUM1    EQU   50      MAJORITY POLLING SLOPE SUMMATION.
0033  SUM2    EQU   51      MAJORITY POLLING SONOGRAM SUMMATION.
      *
      *       **** "LONG TERM" TEMPLATE STORAGE *****
      *
0076  ISTART  EQU   118     START SEGMENT COUNTER.
0077  IHANG   EQU   119     OVERHANG SEGMENTACOUNTER.
0078  IEND    EQU   120     END SEGMENT COUNTER.
0079  THRESH  EQU   121     ENERGY THRESHOLD.
007A  IFRAME  EQU   122     FRAME COUNTER.
007B  INFLAG  EQU   123     IN WORD SEGMENT FLAG.
007C  SLPBUF  EQU   124     ADDRESS OF TOP OF SLOPE BUFFER.
007D  SONBUF  EQU   125     ADDRESS OF TOP OF SONOGRAM BUFFER.
007E  MATCH   EQU   126     MATCH FLAG.
007F  UNOVER  EQU   127     UNDER/OVERFLOW FLAG.(OVERFLOW IF >0,UNDERFLOW
      *
      *           ***PAGE 2 OF DATA RAM***
      *
0000  STATUS  EQU   0       (128) INTERRUPT STORAGE FOR STATUS
0001  SAVARO  EQU   1       (129) INTERRUPT STORAGE FOR AUX REG 0
0002  SAVAR1  EQU   2       (130) INTERRUPT STORAGE FOR AUX REG 1
0003  ACCL    EQU   3       (131) INTERRUPT STORAGE FOR ACC LOW BYTE
0004  ACCH    EQU   4       (132) INTERRUPT STORAGE FOR ACC HIGH BYTE
      *
      *   ***** DEFINE PARAMTERS FOR TEMPLATE GENERATION ROUTINE**
      *
0009  NSTART  EQU   9       ISTART THRESHOLD.
0002  NHANG   EQU   2       IHANG THRESHOLD.
0014  NEND    EQU   20      IEND THRESHOLD.
03E8  TVALUE  EQU   1000    THRESHOLD  VALUE.
00C8  FRMAX   EQU   200     MAXIMUM NUMBER OF FRAMES ALLOWED.
0034  FRMIN   EQU   52      MINIMUM NUMBER OF FRAMES ALLOWED.
0001  NPPE    EQU   1       NUMBER OF PRE-START SAMPLES MINUS 2.
      *
      *
      *       *********DEFINE CONSTANTS**********
      *
      *
0010  SIXTEN  EQU   16
0000  ZERO    EQU   00
      *
0000  MODBUF  EQU   00      MODBUF POINTS TO TOP OF MODULE BUFFER IN ON CH
      *                            DATA RAM.
      *
      *
0FFF  WR0     EQU   4095    TWIDDLE FACTOR 0 \
0000  WI0     EQU   00              |          |
0EC8  WR1     EQU   3784            |        1 |
F9E1  WI1     EQU   -1567           |          |
0850  WR2     EQU   2896            |        2 |
F480  WI2     EQU   -2896           |          |  TWIDDLE FACTORS FOR
061F  WR3     EQU   1567            |        3 |
F138  WI3     EQU   -3784           |          >    16 PT FFT
```

```
0000  WR4   EQU   00              |        4 |
F001  WI4   EQU   -4095           |          |  TO BE ENTERED LATER!!
F9E1  WR5   EQU   -1567           |        5 |
F138  WI5   EQU   -3784           |          |
F4B0  WR6   EQU   -2896           |        6 |
F4B0  WI6   EQU   -2896           |          |
F138  WR7   EQU   -3784   THIDDLE FACTOR 7 /
F9E1  WI7   EQU   -1567
      *
      *
      *
0FFF  PP4R0 EQU   4095    \
FFCE  PP4I0 EQU   -50     |
0FE7  PP4R1 EQU   4071    |
FE3D  PP4I1 EQU   -451    |
0FA7  PP4R2 EQU   4007    |
FC80  PP4I2 EQU   -848    |
0F40  PP4R3 EQU   3904    |
FB2B  PP4I3 EQU   -1237   |
0EB4  PP4R4 EQU   3764    |
F9B3  PP4I4 EQU   -1613   |
0E04  PP4R5 EQU   3588    |
F849  PP4I5 EQU   -1975   |
0D31  PP4R6 EQU   3377    |
F6F3  PP4I6 EQU   -2317   |
0C3E  PP4R7 EQU   3136    |
F583  PP4I7 EQU   -2637    > PRE/POST PROCESSING MULTIPLIERS
0B2C  PP4R8 EQU   2860    |        TO BE ENTERED LATER!
F4BD  PP4I8 EQU   -2931   |
09FF  PP4R9 EQU   2559    |
F383  PP4I9 EQU   -3197   |
08B9  PP4RA EQU   2233    |
F297  PP4IA EQU   -3433   |
075E  PP4RB EQU   1886    |
F1CD  PP4IB EQU   -3635   |
05F0  PP4RC EQU   1520    |
F125  PP4IC EQU   -3803   |
0474  PP4RD EQU   1140    |
F0A3  PP4ID EQU   -3933   |
02ED  PP4RE EQU   749     |
F046  PP4IE EQU   -4026   |
015F  PP4RF EQU   351     |
F010  PP4IF EQU   -4080   /
      *
      *
      ************** DEFINE MACROS ******************************
      *
      *
      *
      *       **** D2DFT PRE/POST-FFT COMPLEX MULTIPLY: ****
      *
      *       (A+iB)*(C+iD) = (AC-BD) + i(AD+BC)
      *       THE ABSOLUTE VALUE IS TAKEN OF THE REAL
      *       AND IMAGINARY PARTS BEFORE STORING.
      *
      *
      CMULT1 $MACRO  A,B,C,D
             ZAC                      * COMPUTE REAL PART.
             UNL                      * UNLIST
             LT      :A:
             MPYK    :C:
             LTA     :B:
             MPYK    :D:
             SPAC
             LT      :A:
             SACH    :A:,4            * ELIMINATE 4 EXTRA SIGN BITS & STORE.
             ZAC                      * COMPUTE IMAG. PART.
             MPYK    :D:
             LTA     :B:
             MPYK    :C:
             APAC
             LIST                     * LIST
             SACH    :B:,4            * ELIMINATE 4 EXTRA SIGN BITS & STORE.
             $END
      *
      *
      CMULT2 $MACRO  A,B,C,D          * SAME AS CMULT1 EXCEPT TAKE ABS
             ZAC                      * COMPUTE REAL PART.
             UNL                      * UNLIST
```

```
0347            LT      :A:
0348            MPYK    :C:
0349            LTA     :B:
0350            MPYK    :D:
0351            SPAC
0352            ABS                     * ABSOLUTE VALUE
0353            LT      :A:
0354            SACH    :A:,4           * ELIMINATE 4 EXTRA SIGN BITS & STORE.
0355            ZAC                     * COMPUTE IMAG. PART.
0356            MPYK    :D:
0357            LTA     :B:
0358            MPYK    :C:
0359            APAC
0360            ABS                     * ABSOLUTE VALUE.
0361            LIST                    * LIST
0362            SACH    :B:,4           * ELIMINATE 4 EXTRA SIGN BITS & STORE.
0363            $END
0364      *
0365      *
0366      *
0367      *     **** DECIMATION-IN-FREQUENCY FFT BUTTERFLY ****
0368      *
0369      *     AR' + jAI' = (AR+BR) + j(AI+BI)
0370      *     BR' + jBI' = ((AR-BR) + j(AI-BI))(WR+jWI)
0371      *
0372      BFLY  $MACRO  AR,AI,BR,BI,WR,WI
0373            LAC     :AR:,15
0374            UNL
0375            ADD     :BR:,15         * AR+BR.
0376            SACH    :AR:
0377            SUBH    :BR:            * AR+BR-2*BR=AR-BR.
0378            SACH    BTEMP
0379            LAC     :AI:,15
0380            ADD     :BI:,15         * AI+BI.
0381            SACH    :AI:
0382            SUBH    :BI:            * AI+BI-2*BI=AI-BI.
0383            SACH    :BI:
0384            ZAC
0385            LT      BTEMP
0386            MPYK    :WR:
0387            LTA     :BI:
0388            MPYK    :WI:
0389            SPAC                    * BR = (AR-BR)*WR - (AI-BI)*WI.
0390            SACH    :BR:,4          * ELIMINATE 4 EXTRA SIGN BITS & STORE.
0391            ZAC
0392            MPYK    :WR:
0393            LTA     BTEMP
0394            MPYK    :WI:
0395            APAC                    * BI = (AI-BI)*WR + (AR-BR)*WI
0396            LIST
0397            SACH    :BI:,4          * ELIMINATE 4 EXTRA SIGN BITS & STORE.
0398            $END
0399      *
0400      *
0401      *     **** TRIVIAL BUTTERFLY COMPUTATION ie. W0=1 ****
0402      *
0403      TRIV  $MACRO  AR,AI,BR,BI
0404            LAC     :AR:,15
0405            UNL
0406            ADD     :BR:,15         * AR'=AR+BR
0407            SACH    :AR:
0408            SUBH    :BR:            * BR'=AR+BR-2*BR=AR-BR
0409            SACH    :BR:
0410            LAC     :AI:,15
0411            ADD     :BI:,15         * AI'=AI+BI
0412            SACH    :AI:
0413            SUBH    :BI:            * BI'=AI+BI-2*BI=AI-BI
0414            LIST
0415            SACH    :BI:
0416            $END
0417      *
0418      *
0419      *
0420      *
0421      ************************************************************
0422      *
0423      *           START OF ACTUAL TMS320 CODE!!!
0424      *
0425      ************************************************************
```

```
0426                *
0427 0000                   ADRG    0
0428                *
0429 0000 F900              B       START          * ON POWER UP,JUMP TO START
     0001 0043
0430                *
0431                *
0432 0002 F900              B       INTSRV         * ON INTERRUPT, JUMP TO INTSRV
     0003 000D
0433                *
0434                *
0435                ************************************************************
0436                *                                                          *
0437                *        DEFINE PROGRAM DATA RAM POINTERS AND CONSTANTS    *
0438                *                                                          *
0439                ************************************************************
0440                *
0441                *   ****** DEFINE CONSTANTS NEEDED FOR DRAM INITIALIZATION *
0442                *
0443 0004 07ED      EDBUF1 DATA     PBUF1E         * END OF PRAM INPUT BUFFER #1.
0444 0005 082D      EDBUF2 DATA     PBUF2E         * END OF PRAM INPUT BUFFER #2.
0445 0006 082E      ADDELA DATA     PMOD           * START OF PRAM MODULE DATA.
0446                *
0447 0007 4989      C0      DATA    18873          * DEN. COEF. C0
0448 0008 F3D8      C1      DATA    -3112          * DEN. COEF. C1
0449 0009 F2E0      C2      DATA    -3360          * DEN. COEF. C2
0450                *
0451 000A 03E8      ADTRSH DATA     TVALUE         * THRESHOLD VALUE FOR TEMPLATE GENERATIO
0452 000B 0A2E      ADSLP  DATA     PSLOP          * PRAM ADDRESS OF TOP OF SLOPE BUFFER.
0453 000C 0AF6      ADSONO DATA     PSONO          * PRAM ADDRESS OF TOP OF SONOGRAM BUFFER.
0454                *
0455                *
0456                *
0457                ************************************************************
0458                *
0459                *       ************INTERRUPT SERVICE ROUTINE******************
0460                *
0461                *       TAKE IN NEW INPUT SAMPLE AND STORE IN PRESENT INPUT BUFFER
0462                *       FILL INPUT BUFFER FROM THE BOTTOM UP!
0463                *
0464                *
0465 000D 7F81      INTSRV DINT                    * DISABLE INTERRUPTS
0466 000E 6E01              LDPK    1              * SWITCH PAGE POINTER
0467 000F 7C00              SST     STATUS         * SAVE CURRENT STATUS.
0468 0010 3001              SAR     0,SAVAR0       * SAVE AUX REG 0
0469 0011 5003              SACL    ACCL           * SAVE ACC LOW BYTE
0470 0012 5804              SACH    ACCH           * SAVE ACC HIGH BYTE
0471 0013 6E00              LDPK    0
0472 0014 6880              LARP    0
0473 0015 4172              IN      INTEMP,PCMIN   * INPUT NEW SAMPLE
0474 0016 2D72              LAC     INTEMP,13      * SCALE INPUT DOWN BY 8.
0475 0017 5872              SACH    INTEMP
0476 0018 206B              LAC     SIGN
0477 0019 FD00              BGEZ    POS
     001A 001E
0478 001B 7F89      NEG     ZAC
0479 001C 1072              SUB     INTEMP         * CHG SIGN OF INPUT IN ALTERNATE BUFFERS.
0480 001D 5072              SACL    INTEMP
0481 001E 206A      POS     LAC     INBUF
0482 001F 386D              LAR     0,INCNT
0483 0020 7D72              TBLW    INTEMP         * WRITE NEW SAMPLE INTO PRAM INPUT BUFFER.
0484 0021 1074              SUB     ONE            * DECREMENT INBUF.
0485 0022 F400              BANZ    IRET
     0023 0031
0486 0024 206B              LAC     SIGN           * SWAP SIGN FLAGS(0/-1).
0487 0025 0074              ADD     ONE
0488 0026 506B              SACL    SIGN
0489 0027 0175              ADD     NEGONE,1
0490 0028 FE00              BNZ     POSS2
     0029 002C
0491 002A 2175              LAC     NEGONE,1
0492 002B 506B              SACL    SIGN
0493 002C 6667      POSS2   ZALS    BUF2           * IF BUFFER FULL SWITCH BUFFER ADDRESSES.
0494 002D 6966              DMOV    BUF1
0495 002E 5066              SACL    BUF1
0496 002F 5069              SACL    BUFFUL         * IF BUFFER FULL SET FLAG FOR MAIN.
0497 0030 703F              LARK    0,63           * INITIALIZE INCNT.
0498 0031 306D      IRET    SAR     0,INCNT        * UPDATE INPUT COUNTER.
0499 0032 506A              SACL    INBUF          * STORE INBUF.
```

```
0500                *
0501                ********THE FOLLOWING IS A FIX FOR THE SIMULATOR*********
0502                *       THE AUX REGISTER POINTER MUST BE LOADED          *
0503                *       MANUALLY!                                        *
0504                *                                                        *
0505 0033 2874              LAC     ONE,8       ******* MASK OUT ARP.        *
0506 0034 6E01              LDPK    1                   * (THIS INST. NEEDED)  *
0507 0035 7B00              LST     STATUS              * (THIS INST. NEEDED)  *
0508 0036 7900              AND     STATUS              *                      *
0509 0037 FE00              BNZ     ARP1                *                      *
     0038 003C
0510 0039 6880      ARP0    LARP    0                   * RESTORE ARP.         *
0511 003A F900              B       LOADAC              *                      *
     003B 003D
0512 003C 6881      ARP1    LARP    1           *******                        *
0513                ********************************************************
0514                *
0515 003D 6504      LOADAC  ZALH    ACCH                * RESTORE ACC,AUX REG'S,AND STATUS
0516 003E 7A03              OR      ACCL
0517 003F 3801              LAR     0,SAVARO
0518 0040 6E00              LDPK    0
0519 0041 7F82              EINT                        * ENABLE INTERRUPTS
0520 0042 7F8D              RET
0521                *
0522                ***********END OF INTERRUPT SERVICE ROUTINE*****************
0523                *
0524                *
0525                ************************************************************
0526                *
0527                *       BEGINNING OF POWER ON RESET ROUTINE
0528                *
0529                *       DATA RAM MUST BE INITIALIZED WITH ALL CONSTANTS
0530                *       AND DATA POINTERS!
0531                *
0532                ************************************************************
0533                *
0534 0043 7F81      START   DINT                        * DISABLE INTERRUPT.
0535 0044 6E00              LDPK    0                   * SET DATA PAGE POINTER.
0536                *
0537 0045 7E1F              LACK    31                  * INITIALIZE CONSTANT 31.
0538 0046 5073              SACL    NUM31
0539                *
0540 0047 7E01              LACK    01                  * INITIALIZE CONSTANT 1.
0541 0048 5074              SACL    ONE
0542                *
0543 0049 7F89              ZAC                         * INITIALIZE CONSTANT -1.
0544 004A 1074              SUB     ONE
0545 004B 5075              SACL    NEGONE
0546 004C 1074              SUB     ONE
0547 004D 506B              SACL    SIGN                * INITIALIZE BUFFER SIGN MULTIPLIER.
0548                *
0549 004E 7E04              LACK    EDBUF1
0550 004F 6766              TBLR    BUF1                * INITIALIZE BUF1.
0551 0050 676A              TBLR    INBUF               * INITIALIZE INBUF.
0552 0051 7E05              LACK    EDBUF2
0553 0052 6767              TBLR    BUF2                * INITIALIZE BUF2.
0554 0053 676C              TBLR    OUTBUF              * INITIALIZE OUTBUF.
0555 0054 7E06              LACK    ADDELA
0556 0055 676B              TBLR    MODDEL              * INITIALIZE MODDEL.
0557 0056 7E3F              LACK    63
0558 0057 5060              SACL    INCNT               * INITIALIZE INCNT.
0559 0058 7F89              ZAC
0560 0059 5069              SACL    BUFFUL              * INITIALIZE BUFFUL FLAG
0561                *
0562                *    **** INITIALIZE TEMPLATE GENERATION VARIABLES ****
0563                *
0564 005A 5076              SACL    ISTART
0565 005B 5077              SACL    IHANG
0566 005C 5078              SACL    IEND
0567 005D 507F              SACL    HOVER
0568 005E 507B              SACL    INFLAG
0569 005F 507E              SACL    MATCH
0570 0060 7E0A              LACK    ADTRSH
0571 0061 6779              TBLR    THRESH              * LOAD VALUE OF ENERGY THRESHOLD.
0572 0062 7E01              LACK    NPRE
0573 0063 507A              SACL    IFRAME
0574 0064 7E0B              LACK    ADSLP
0575 0065 677C              TBLR    SLPBUF
0576 0066 7E0C              LACK    ADSONO
```

```
0577 0067 677D          TBLR    SONBUF
0578              *
0579              *     ***INITIALIZE DENOMINATOR COEFFICIENTS****
0580              *
0581              *
0582 006A 7E07          LACK    C0
0583 0069 6763          TBLR    CC0       * INITIALIZE C0.
0584 006A 7E08          LACK    C1
0585 006B 6764          TBLR    CC1       * INITIALIZE C1.
0586 006C 7E09          LACK    C2
0587 006D 6765          TBLR    CC2       * INITIALIZE C2.
0588              *
0589              *      *********DATA RAM INITIALIZED************
0590              *
0591              *
0592              **********ENABLE INTERRUPT AND START MAIN LOOP**************
0593              *
0594 006E 7F92          EINT                        * ENABLE INTERRUPT.
0595              *
0596 006F 7E00    MAIN  LACK    0
0597 0070 506E          SACL    MODCNT              * INITIALIZE MODULE COUNT.
0598 0071 7E3F          LACK    63
0599 0072 506F          SACL    CNTMOD              * INITIALIZE 64-MODCNT.
0600 0073 7E00          LACK    S001
0601 0074 5070          SACL    SOCNT               * INITIALIZE SOCNT.
0602 0075 7E3F          LACK    SE32
0603 0076 5071          SACL    SECNT               * INITIALIZE SECNT.
0604              *
0605 0077 2069    WAIT1 LAC     BUFFUL              * WAIT FOR INPUT BUFFER TO FILL!
0606 0078 FF00          BZ      WAIT1
     0079 0077
0607              *
0608 007A 7F89          ZAC                         * ZERO ACC.
0609 0078 5069          SACL    BUFFUL              * CLEAR BUFFER FULL FLAG.
0610 007C 2066          LAC     BUF1
0611 007D 506A          SACL    INBUF               * INITIALIZE INBUF.
0612 007E 2067          LAC     BUF2
0613 007F 506C          SACL    OUTBUF              * INITIALIZE OUTBUF.
0614              *
0615              *****************FILTER MODULE LOOP*************************
0616              *
0617 0080 F800    LOOP1 CALL    MODIN               * MODULED DATA INPUT.
     0081 009E
0618 0082 F800          CALL    MODULE              * MODULE COMPUTATION.
     0083 00CC
0619 0084 F800          CALL    MODOUT              * MODULE DATA OUTPUT.
     0085 0109
0620 0086 206E          LAC     MODCNT              * TEST LOOP END?
0621 0087 1073          SUB     NUM31
0622 0088 F800          BLEZ    LOOP1
     0089 0080
0623              *     CALL    OUTSO               * OUTPUT SO.
0624              *     CALL    OUTSE               * OUTPUT SE.
0625 008A F800          CALL    O2DFT               * COMPUTE ODD-TIME O2DFT.
0626              *     CALL    OUTPUT              * OUTPUT ODD SAMPLES TO PCMOUT.
0627 008C F800          CALL    ODDOV               * SHIFT EVEN SAMPLES INTO ODD BUFFER.
     008D 069B
0628 008E F800          CALL    O2DFT               * COMPUTE EVEN-TIME O2DFT.
     008F 0121
0629              *     CALL    OUTPUT              * OUTPUT EVEN SAMPLES TO PCMOUT.
0630 0090 F800          CALL    AVERAG              * AVERAGE ODD & EVEN.
     0091 071C
0631              *     CALL    OUTSE               * OUTPUT AVERAGED DATA.
0632 0092 F800          CALL    MERGE               * MERGE 32 BANDS INTO 16 COMPOSITE BANDS.
     0093 0725
0633              *     CALL    OUTSO2              * OUTPUT 16 COMPOSITE BANDS.
0634 0094 F800          CALL    IIR                 * IIR FILTER THE DATA.
     0095 0750
0635              *     CALL    BANDOT              * OUTPUT BAND DATA TO BE DISPLAYED.
0636              *     CALL    OUTSO2              * OUTPUT FILTERED DATA.
0637 0096 F800          CALL    ENERGY              * COMPUTE TOTAL ENERGY IN A FRAME.
     0097 0766
0638 0098 F800          CALL    BINENC              * BINARY ENCODING OF FRAME DATA.
     0099 0770
0639              *     CALL    OUTBIN              * OUTPUT SLOPE AND SONOGRAM WORDS.
0640 009A F800          CALL    TMPGEN              * CALL TEMPLATE GENERATION PROGRAM.
     009B 051F
0641 009C F900          B       MAIN                * JUMP TO TOP OF MAIN LOOP!
     009D 006F
```

```
0642                *
0643                *          ****MODULE DATA INPUT ROUTINE****
0644                *
0645 009E 6880  MODIN  LARP    0
0646 009F 7040         LARK    0,A0            * LOAD AUX REG 0 W/DRAM BUFFER ADDRESS.
0647 00A0 2068         LAC     MODDEL          * LOAD ACC W/ADDRESS OF MOD. DATA IN PRAM.
0648 00A1 046E         ADD     MODCNT,4        * ADD OFFSET:MODULE COUNT*16.
0649 00A2 67A0         TBLR    *+,0            * READ MOD DATA FROM PRAM INTO DRAM
0650 00A3 0074         ADD     ONE             \
0651 00A4 67A0         TBLR    *+,0            |
0652 00A5 0074         ADD     ONE             |
0653 00A6 67A0         TBLR    *+,0             >       READ A0-A3
0654 00A7 0074         ADD     ONE             |
0655 00A8 67A0         TBLR    *+,0            /
0656 00A9 0074         ADD     ONE
0657 00AA 67A0         TBLR    *+,0            \
0658 00AB 0074         ADD     ONE             |
0659 00AC 67A0         TBLR    *+,0            |
0660 00AD 0074         ADD     ONE              >       READ B0-B3
0661 00AE 67A0         TBLR    *+,0            |
0662 00AF 0074         ADD     ONE             |
0663 00B0 67A0         TBLR    *+,0            /
0664 00B1 0074         ADD     ONE
0665 00B2 67A0         TBLR    *+,0            \
0666 00B3 0074         ADD     ONE             |
0667 00B4 67A0         TBLR    *+,0            |
0668 00B5 0074         ADD     ONE              >       READ Z20-Z23
0669 00B6 67A0         TBLR    *+,0            |
0670 00B7 0074         ADD     ONE             |
0671 00B8 67A0         TBLR    *+,0            /
0672 00B9 0074         ADD     ONE
0673 00BA 67A0         TBLR    *+,0            \
0674 00BB 0074         ADD     ONE             |
0675 00BC 67A0         TBLR    *+,0            |
0676 00BD 0074         ADD     ONE              >       READ Z10-Z13
0677 00BE 67A0         TBLR    *+,0            |
0678 00BF 0074         ADD     ONE             |
0679 00C0 67A0         TBLR    *+,0            /
0680 00C1 206C         LAC     OUTBUF
0681 00C2 106F         SUB     CNTMOD
0682 00C3 68A0         AAR     *+,0            * SKIP OVER Z14 IN DRAM BUFFER.
0683 00C4 67A0         TBLR    *+,0            * READ NEW INPUT X(n).
0684 00C5 206C         LAC     OUTBUF
0685 00C6 106E         SUB     MODCNT
0686 00C7 67A0         TBLR    *+,0            * READ NEW INPUT X(N-n).
0687 00C8 206F         LAC     CNTMOD
0688 00C9 1074         SUB     ONE
0689 00CA 506F         SACL    CNTMOD          * DECREMENT CNTMOD.
0690 00CB 7F9D         RET
0691                *
0692                *
0693                *      ****FILTER MODULE****
0694                *
0695                *
0696 00CC 694F  MODULE DMOV    Z13
0697 00CD 6B4E         LTD     Z12      \
0698 00CE 2F51         LAC     X1,15    |
0699 00CF 6D65         MPY     CC2      |
0700 00D0 6B4D         LTD     Z11      |
0701 00D1 6D64         MPY     CC1       >      FIRST RECURSIVE SECTION
0702 00D2 6B4C         LTD     Z10      |
0703 00D3 6D63         MPY     CC0      |
0704 00D4 6B4A         LTD     Z22      |
0705 00D5 594C         SACH    Z10,1    /
0706                *
0707 00D6 2F52         LAC     XN,15    \
0708 00D7 6D65         MPY     CC2      |
0709 00D8 6B49         LTD     Z21      |
0710 00D9 6D64         MPY     CC1       >      SECOND RECURSIVE SECTION
0711 00DA 6B48         LTD     Z20      |
0712 00DB 6D63         MPY     CC0      |
0713 00DC 7F9F         APAC             |
0714 00DD 5948         SACH    Z20,1    /
0715                *
0716 00DE 7F99         ZAC
0717 00DF 6A4C         LT      Z10
0718 00E0 6D40         MPY     A0
0719 00E1 6C4D         LTA     Z11
```

```
0720 00E2 6D41          MPY     A1
0721 00E3 6C4E          LTA     Z12
0722 00E4 6D42          MPY     A2
0723 00E5 6C4F          LTA     Z13
0724 00E6 6D43          MPY     A3
0725 00E7 6C48          LTA     Z20
0726 00E8 6D43          MPY     A3
0727 00E9 6C49          LTA     Z21
0728 00EA 6D42          MPY     A2
0729 00EB 6C4A          LTA     Z22
0730 00EC 6D41          MPY     A1
0731 00ED 6C4B          LTA     Z23
0732 00EE 6D40          MPY     A0
0733 00EF 7F8F          APAC
0734 00F0 3870          LAR     0,SOCNT
0735 00F1 59A0          SACH    *+,1,0          * STORE ODD RESULT.
0736 00F2 3070          SAR     0,SOCNT         * UPDATE SO COUNTER.
0737 00F3 7F89          ZAC
0738 00F4 6A4D          LT      Z11
0739 00F5 6D44          MPY     B0
0740 00F6 6C4E          LTA     Z12
0741 00F7 6D45          MPY     B1
0742 00F8 6C4F          LTA     Z13
0743 00F9 6D46          MPY     B2
0744 00FA 6C50          LTA     Z14
0745 00FB 6D47          MPY     B3
0746 00FC 6C48          LTA     Z20
0747 00FD 6D47          MPY     B3
0748 00FE 6C49          LTA     Z21
0749 00FF 6D46          MPY     B2
0750 0100 6C4A          LTA     Z22
0751 0101 6D45          MPY     B1
0752 0102 6C4B          LTA     Z23
0753 0103 6D44          MPY     B0
0754 0104 7F8F          APAC
0755 0105 3871          LAR     0,SECNT
0756 0106 5990          SACH    *-,1,0          * STORE EVEN RESULT
0757 0107 3071          SAR     0,SECNT         * UPDATE SE COUNTER.
0758 0108 7F8D          RET
0759            *
0760            *
0761            *       ****WRITE NEW DELAY CHAIN OUT TO PRAM!!!*****
0762            *
0763            *
0764 0109 6880  MODOUT  LARP    0
0765 010A 7048          LARK    0,Z20           * LOAD AUX REG W/DRAM DELAY DATA ADDRESS.
0766 010B 246E          LAC     MODCNT,4        * LOAD ACC W/MODCNT*16
0767 010C 0068          ADD     MODDEL          * ADD PRAM ADDRESS TO ACC.
0768 010D 0374          ADD     ONE,3           * ADD PRAM OUTPUT OFFSET OF 8.
0769 010E 7DA0          TBLW    *+,0            * WRITE DATA TO PRAM.
0770 010F 0074          ADD     ONE
0771 0110 7DA0          TBLW    *+,0            * WRITE DATA TO PRAM.
0772 0111 0074          ADD     ONE
0773 0112 7DA0          TBLW    *+,0            * WRITE DATA TO PRAM.
0774 0113 0074          ADD     ONE
0775 0114 7DA0          TBLW    *+,0            * WRITE DATA TO PRAM.
0776 0115 0074          ADD     ONE
0777 0116 7DA0          TBLW    *+,0            * WRITE DATA TO PRAM.
0778 0117 0074          ADD     ONE
0779 0118 7DA0          TBLW    *+,0            * WRITE DATA TO PRAM.
0780 0119 0074          ADD     ONE
0781 011A 7DA0          TBLW    *+,0            * WRITE DATA TO PRAM.
0782 011B 0074          ADD     ONE
0783 011C 7DA0          TBLW    *+,0            * WRITE DATA TO PRAM.
0784 011D 206F          LAC     MODCNT
0785 011E 0074          ADD     ONE
0786 011F 506F          SACL    MODCNT          * INCREMENT MODCNT
0787 0120 7F8D          RET
0788            *
0789            *
0790            *
0791            *************** 32 POINT O2DFT ****************************
0792            *
0793            *       *** ODD TIME O2DFT ***
0794            *
0795            O2DFT   CMULT1  S001,S032,PPMR0,PPMI0   * ODD TIME O2DFT PRE-SCAL
0001 0121 7F89   ZAC    * COMPUTE REAL PART.
0016 012E 5C1F   SACH S032,4  * ELIMINATE 4 EXTRA SIGN BITS & STORE.
0796                    CMULT1  S003,S030,PPMR1,PPMI1
```

```
0001 012F 7F89   ZAC    * COMPUTE REAL PART.
0016 013C 5C1D   SACH S030,4  * ELIMINATE 4 EXTRA SIGN BITS & STORE.
0797                  CMULT1  S005,S028,PPMR2,PPMI2
0001 013D 7F89   ZAC    * COMPUTE REAL PART.
0016 014A 5C1B   SACH S028,4  * ELIMINATE 4 EXTRA SIGN BITS & STORE.
0798                  CMULT1  S007,S026,PPMR3,PPMI3
0001 014B 7F89   ZAC    * COMPUTE REAL PART.
0016 0158 5C19   SACH S026,4  * ELIMINATE 4 EXTRA SIGN BITS & STORE.
0799                  CMULT1  S009,S024,PPMR4,PPMI4
0001 0159 7F89   ZAC    * COMPUTE REAL PART.
0016 0166 5C17   SACH S024,4  * ELIMINATE 4 EXTRA SIGN BITS & STORE.
0800                  CMULT1  S011,S022,PPMR5,PPMI5
0001 0167 7F89   ZAC    * COMPUTE REAL PART.
0016 0174 5C15   SACH S022,4  * ELIMINATE 4 EXTRA SIGN BITS & STORE.
0801                  CMULT1  S013,S020,PPMR6,PPMI6
0001 0175 7F89   ZAC    * COMPUTE REAL PART.
0016 0182 5C13   SACH S020,4  * ELIMINATE 4 EXTRA SIGN BITS & STORE.
0802                  CMULT1  S015,S018,PPMR7,PPMI7
0001 0183 7F89   ZAC    * COMPUTE REAL PART.
0016 0190 5C11   SACH S018,4  * ELIMINATE 4 EXTRA SIGN BITS & STORE.
0803                  CMULT1  S017,S016,PPMR8,PPMI8
0001 0191 7F89   ZAC    * COMPUTE REAL PART.
0016 019E 5C0F   SACH S016,4  * ELIMINATE 4 EXTRA SIGN BITS & STORE.
0804                  CMULT1  S019,S014,PPMR9,PPMI9
0001 019F 7F89   ZAC    * COMPUTE REAL PART.
0016 01AC 5C0D   SACH S014,4  * ELIMINATE 4 EXTRA SIGN BITS & STORE.
0805                  CMULT1  S021,S012,PPMRA,PPMIA
0001 01AD 7F89   ZAC    * COMPUTE REAL PART.
0016 01BA 5C0B   SACH S012,4  * ELIMINATE 4 EXTRA SIGN BITS & STORE.
0806                  CMULT1  S023,S010,PPMRB,PPMIB
0001 01BB 7F89   ZAC    * COMPUTE REAL PART.
0016 01C8 5C09   SACH S010,4  * ELIMINATE 4 EXTRA SIGN BITS & STORE.
0807                  CMULT1  S025,S008,PPMRC,PPMIC
0001 01C9 7F89   ZAC    * COMPUTE REAL PART.
0016 01D6 5C07   SACH S008,4  * ELIMINATE 4 EXTRA SIGN BITS & STORE.
0808                  CMULT1  S027,S006,PPMRD,PPMID
0001 01D7 7F89   ZAC    * COMPUTE REAL PART.
0016 01E4 5C05   SACH S006,4  * ELIMINATE 4 EXTRA SIGN BITS & STORE.
0809                  CMULT1  S029,S004,PPMRE,PPMIE
0001 01E5 7F89   ZAC    * COMPUTE REAL PART.
0016 01F2 5C03   SACH S004,4  * ELIMINATE 4 EXTRA SIGN BITS & STORE.
0810                  CMULT1  S031,S002,PPMRF,PPMIF
0001 01F3 7F89   ZAC    * COMPUTE REAL PART.
0016 0200 5C01   SACH S002,4  * ELIMINATE 4 EXTRA SIGN BITS & STORE.
0811             OFFTS1 TRIV    S001,S032,S017,S016            * ODD TIME FFT STAGE 1.
0001 0201 2F00   LAC S001,15
0012 020A 580F   SACH S016
0812                  BFLY    S009,S024,S025,S008,WR4,WI4
0001 020B 2F08   LAC S009,15
0025 0221 5C07   SACH S008,4  * ELIMINATE 4 EXTRA SIGN BITS & STORE.
0813                  BFLY    S005,S028,S021,S012,WR2,WI2
0001 0222 2F04   LAC S005,15
0025 0238 5C0B   SACH S012,4  * ELIMINATE 4 EXTRA SIGN BITS & STORE.
0814                  BFLY    S013,S020,S029,S004,WR6,WI6
0001 0239 2F0C   LAC S013,15
0025 024F 5C03   SACH S004,4  * ELIMINATE 4 EXTRA SIGN BITS & STORE.
0815                  BFLY    S003,S030,S019,S014,WR1,WI1
0001 0250 2F02   LAC S003,15
0025 0266 5C0D   SACH S014,4  * ELIMINATE 4 EXTRA SIGN BITS & STORE.
0816                  BFLY    S011,S022,S027,S006,WR5,WI5
0001 0267 2F0A   LAC S011,15
0025 027D 5C05   SACH S006,4  * ELIMINATE 4 EXTRA SIGN BITS & STORE.
0817                  BFLY    S007,S026,S023,S010,WR3,WI3
0001 027E 2F06   LAC S007,15
0025 0294 5C09   SACH S010,4  * ELIMINATE 4 EXTRA SIGN BITS & STORE.
0818                  BFLY    S015,S018,S031,S002,WR7,WI7
0001 0295 2F0E   LAC S015,15
0025 02AB 5C01   SACH S002,4  * ELIMINATE 4 EXTRA SIGN BITS & STORE.
0819             OFFTS2 TRIV    S001,S032,S009,S024            * ODD TIME FFT STAGE 2.
0001 02AC 2F00   LAC S001,15
0012 02B5 5817   SACH S024
0820                  TRIV    S017,S016,S025,S008
0001 02B6 2F10   LAC S017,15
0012 02BF 5807   SACH S008
0821                  BFLY    S005,S028,S013,S020,WR4,WI4
0001 02C0 2F04   LAC S005,15
0025 02D6 5C13   SACH S020,4  * ELIMINATE 4 EXTRA SIGN BITS & STORE.
0822                  BFLY    S021,S012,S029,S004,WR4,WI4
```

```
0001 02D7 2F14   LAC S021,15
0025 02ED 5C03   SACH S004,4   * ELIMINATE 4 EXTRA SIGN BITS & STORE.
0823                 BFLY      S003,S030,S011,S022,WR2,WI2
0001 02EF 2F02   LAC S003,15
0025 0304 5C15   SACH S022,4   * ELIMINATE 4 EXTRA SIGN BITS & STORE.
0824                 BFLY      S019,S014,S027,S006,WR2,WI2
0001 0305 2F12   LAC S019,15
0025 031B 5C05   SACH S006,4   * ELIMINATE 4 EXTRA SIGN BITS & STORE.
0825                 BFLY      S007,S026,S015,S018,WR6,WI6
0001 031C 2F06   LAC S007,15
0025 0332 5C11   SACH S018,4   * ELIMINATE 4 EXTRA SIGN BITS & STORE.
0826                 BFLY      S023,S010,S031,S002,WR6,WI6
0001 0333 2F16   LAC S023,15
0025 0349 5C01   SACH S002,4   * ELIMINATE 4 EXTRA SIGN BITS & STORE.
0827             OFFTS3 TRIV   S001,S032,S005,S028            * ODD TIME FFT STAGE 3.
0001 034A 2F00   LAC S001,15
0012 0353 581B   SACH S028
0828                 TRIV      S017,S016,S021,S012
0001 0354 2F10   LAC S017,15
0012 035D 580B   SACH S012
0829                 TRIV      S009,S024,S013,S020
0001 035E 2F08   LAC S009,15
0012 0367 5813   SACH S020
0830                 TRIV      S025,S008,S029,S004
0001 0368 2F18   LAC S025,15
0012 0371 5803   SACH S004
0831                 BFLY      S003,S030,S007,S026,WR4,WI4
0001 0372 2F02   LAC S003,15
0025 0388 5C19   SACH S026,4   * ELIMINATE 4 EXTRA SIGN BITS & STORE.
0832                 BFLY      S019,S014,S023,S010,WR4,WI4
0001 0389 2F12   LAC S019,15
0025 039F 5C09   SACH S010,4   * ELIMINATE 4 EXTRA SIGN BITS & STORE.
0833                 BFLY      S011,S022,S015,S018,WR4,WI4
0001 03A0 2F0A   LAC S011,15
0025 03B6 5C11   SACH S018,4   * ELIMINATE 4 EXTRA SIGN BITS & STORE.
0834                 BFLY      S027,S006,S031,S002,WR4,WI4
0001 03B7 2F1A   LAC S027,15
0025 03CD 5C01   SACH S002,4   * ELIMINATE 4 EXTRA SIGN BITS & STORE.
0835             OFFTS4 TRIV   S001,S032,S003,S030            * ODD TIME FFT STAGE 4.
0001 03CE 2F00   LAC S001,15
0012 03D7 581D   SACH S030
0836                 TRIV      S017,S016,S019,S014
0001 03D8 2F10   LAC S017,15
0012 03E1 580D   SACH S014
0837                 TRIV      S009,S024,S011,S022
0001 03E2 2F08   LAC S009,15
0012 03EB 5815   SACH S022
0838                 TRIV      S025,S008,S027,S006
0001 03EC 2F18   LAC S025,15
0012 03F5 5805   SACH S006
0839                 TRIV      S005,S028,S007,S026
0001 03F6 2F04   LAC S005,15
0012 03FF 5819   SACH S026
0840                 TRIV      S021,S012,S023,S010
0001 0400 2F14   LAC S021,15
0012 0409 5809   SACH S010
0841                 TRIV      S013,S020,S015,S018
0001 040A 2F0C   LAC S013,15
0012 0413 5811   SACH S018
0842                 TRIV      S029,S004,S031,S002
0001 0414 2F1C   LAC S029,15
0012 041D 5801   SACH S002
0843             OPOST  CMULT2 S001,S032,PPMR0,PPMI0          * ODD TIME POST-MULTIPLY
0001 041E 7F89   ZAC    * COMPUTE REAL PART.
0018 042D 5C1F   SACH S032,4   * ELIMINATE 4 EXTRA SIGN BITS & STORE.
0844                 CMULT2  S017,S016,PPMR1,PPMI1
0001 042E 7F89   ZAC    * COMPUTE REAL PART.
0018 043D 5C0F   SACH S016,4   * ELIMINATE 4 EXTRA SIGN BITS & STORE.
0845                 CMULT2  S009,S024,PPMR2,PPMI2
0001 043E 7F89   ZAC    * COMPUTE REAL PART.
0018 044D 5C17   SACH S024,4   * ELIMINATE 4 EXTRA SIGN BITS & STORE.
0846                 CMULT2  S025,S008,PPMR3,PPMI3
0001 044E 7F89   ZAC    * COMPUTE REAL PART.
0018 045D 5C07   SACH S008,4   * ELIMINATE 4 EXTRA SIGN BITS & STORE.
0847                 CMULT2  S005,S028,PPMR4,PPMI4
0001 045E 7F89   ZAC    * COMPUTE REAL PART.
0018 046D 5C1B   SACH S028,4   * ELIMINATE 4 EXTRA SIGN BITS & STORE.
0848                 CMULT2  S021,S012,PPMR5,PPMI5
0001 046E 7F89   ZAC    * COMPUTE REAL PART.
```

```
0018 047D 5C08   SACH S012,4   * ELIMINATE 4 EXTRA SIGN BITS & STORE.
0849                CMULT2  S013,S020,PPMR6,PPMI6
0001 047E 7F89   ZAC    * COMPUTE REAL PART.
0018 048D 5C13   SACH S020,4   * ELIMINATE 4 EXTRA SIGN BITS & STORE.
0850                CMULT2  S029,S004,PPMR7,PPMI7
0001 048E 7F89   ZAC    * COMPUTE REAL PART.
0018 049D 5C03   SACH S004,4   * ELIMINATE 4 EXTRA SIGN BITS & STORE.
0851                CMULT2  S003,S030,PPMR8,PPMI8
0001 049E 7F89   ZAC    * COMPUTE REAL PART.
0018 04AD 5C1D   SACH S030,4   * ELIMINATE 4 EXTRA SIGN BITS & STORE.
0852                CMULT2  S019,S014,PPMR9,PPMI9
0001 04AE 7F89   ZAC    * COMPUTE REAL PART.
0018 04BD 5C0D   SACH S014,4   * ELIMINATE 4 EXTRA SIGN BITS & STORE.
0853                CMULT2  S011,S022,PPMRA,PPMIA
0001 04BE 7F89   ZAC    * COMPUTE REAL PART.
0018 04CD 5C15   SACH S022,4   * ELIMINATE 4 EXTRA SIGN BITS & STORE.
0854                CMULT2  S027,S006,PPMRB,PPMIB
0001 04CE 7F89   ZAC    * COMPUTE REAL PART.
0018 04DD 5C05   SACH S006,4   * ELIMINATE 4 EXTRA SIGN BITS & STORE.
0855                CMULT2  S007,S026,PPMRC,PPMIC
0001 04DE 7F89   ZAC    * COMPUTE REAL PART.
0018 04ED 5C19   SACH S026,4   * ELIMINATE 4 EXTRA SIGN BITS & STORE.
0856                CMULT2  S023,S010,PPMRD,PPMID
0001 04EE 7F89   ZAC    * COMPUTE REAL PART.
0018 04FD 5C09   SACH S010,4   * ELIMINATE 4 EXTRA SIGN BITS & STORE.
0857                CMULT2  S015,S018,PPMRE,PPMIE
0001 04FE 7F89   ZAC    * COMPUTE REAL PART.
0018 050D 5C11   SACH S018,4   * ELIMINATE 4 EXTRA SIGN BITS & STORE.
0858                CMULT2  S031,S002,PPMRF,PPMIF
0001 050E 7F89   ZAC    * COMPUTE REAL PART.
0018 051D 5C01   SACH S002,4   * ELIMINATE 4 EXTRA SIGN BITS & STORE.
0859 051E 7F8D          RET
0860             *
0861 051F 7F80   TMPGEN NOP
0862 0520 2077          LAC     IHANG
0863 0521 FF00          BZ      OVRTST          * TEST FOR (over)HANG OF WORD.
     0522 0525
0864 0523 0074          ADD     ONE
0865 0524 5077          SACL    IHANG           * INC. IHANG.
0866 0525 207F   OVRTST LAC     UNOVER          * TEST FOR OVERFLOW.
0867 0526 FC00          BGZ     INTST
     0527 0530
0868 0528 207A   NOTOVR LAC     IFRAME
0869 0529 0074          ADD     ONE
0870 052A 507A          SACL    IFRAME          * INC. FRAME COUNT.
0871 052B 007C          ADD     SLPBUF
0872 052C 7D12          TBLW    SLOPE           * BUFFER UP NEW SLOPE WORD.
0873 052D 207A          LAC     IFRAME
0874 052E 007D          ADD     SONBUF
0875 052F 7D14          TBLW    SOND            * BUFFER UP NEW SONOGRAM WORD.
0876 0530 207B   INTST  LAC     INFLAG          * TEST FOR "IN" SEGMENT OF WORD.
0877 0531 FE00          BNZ     INWORD
     0532 0562
0878 0533 6511   NOTIN  ZALH    ENERGH
0879 0534 7A10          OR      ENERGL
0880 0535 1079          SUB     THRESH          * TEST ENERGY THRESHOLD.
0881 0536 FD00          BGEZ    ENERG1
     0537 0554
0882 0538 7F89   NOEN1  ZAC
0883 0539 5076          SACL    ISTART          * CLEAR START FLAG.
0884 053A 2077          LAC     IHANG           * TEST HANG FLAG.
0885 053B FE00          BNZ     HNG1
     053C 059C
0886 053D 7E01   NOHNG1 LACK    NPRE
0887 053E 507A          SACL    IFRAME          * RESET IFRAME TO NPRE.
0888 053F 6881          LARP    1
0889 0540 7101          LARK    1,NPRE
0890 0541 207C          LAC     SLPBUF
0891 0542 0074   SHUFL1 ADD     ONE             * SHIFT SLOPE DATA DOWN
0892 0543 6715          TBLR    SLPTMP            ONE WORD.
0893 0544 1074          SUB     ONE
0894 0545 7D15          TBLW    SLPTMP
0895 0546 0074          ADD     ONE
0896 0547 F400          BANZ    SHUFL1
     0548 0542
0897 0549 7101          LARK    1,NPRE
0898 054A 207D          LAC     SONBUF
0899 054B 0074   SHUFL2 ADD     ONE             * SHIFT SONOGRAM DATA DOWN
0900 054C 6716          TBLR    SONTMP            ONE WORD.
```

```
0901 054D 1074          SUB     ONE
0902 054E 7D16          TBLW    SONTMP
0903 054F 0074          ADD     ONE
0904 0550 F400          BANZ    SHUFL2
     0551 054B
0905 0552 F900          B       HNG1
     0553 059C
0906 0554 2076  ENERG1  LAC     ISTART
0907 0555 0074          ADD     ONE             * INC. ISTART.
0908 0556 5076          SACL    ISTART
0909 0557 7E09          LACK    NSTART          * TEST ISTART VALUE.
0910 0558 1076          SUB     ISTART
0911 0559 FD00          BGEZ    MATCH1
     055A 0580
0912 055B 2074          LAC     ONE
0913 055C 507B          SACL    INFLAG          * SET INFLAG.
0914 055D 7F89          ZAC
0915 055E 5078          SACL    IEND            * CLEAR IEND FLAG.
0916 055F 5076          SACL    ISTART          * CLEAR ISTART FLAG.
0917 0560 F900          B       MATCH1
     0561 0580
0918 0562 6511  INWORD  ZALH    ENERGH          * TEST ENERGY THRESHOLD.
0919 0563 7A10          OR      ENERGL
0920 0564 1079          SUB     THRESH
0921 0565 FD00          BGEZ    ENERG2
     0566 0576
0922 0567 2078  NOEN2   LAC     IEND            * INC. IEND.
0923 0568 0074          ADD     ONE
0924 0569 5078          SACL    IEND
0925 056A 7E14          LACK    NEND            * TEST IEND FLAG.
0926 056B 1078          SUB     IEND
0927 056C FD00          BGEZ    MATCH1
     056D 0580
0928 056E 7F89  YESEND  ZAC
0929 056F 507B          SACL    INFLAG          * CLEAR INFLAG.
0930 0570 5076          SACL    ISTART          * CLEAR ISTART.
0931 0571 5078          SACL    IEND            * CLEAR IEND.
0932 0572 2074          LAC     ONE
0933 0573 5077          SACL    IHANG           * SET IHANG TO ONE.
0934 0574 F900          B       HNG1
     0575 059C
0935 0576 7F89  ENERG2  ZAC
0936 0577 5078          SACL    IEND            * CLEAR IEND.
0937 0578 7EC8          LACK    FRMAX
0938 0579 107A          SUB     IFRAME          * TEST IFRAME VALUE
0939 057A FD00          BGEZ    MATCH1
     057B 0580
0940 057C 2074  YESOVR  LAC     ONE             * SET UNOVER FLAG TO OVERFLOW.
0941 057D 507F          SACL    UNOVER            SEND OVERFLOW INTERRUPT.
0942 057E F900          B       HNG1
     057F 059C
0943 0580 207E  MATCH1  LAC     MATCH
0944 0581 FE00          BNZ     MATCH2
     0582 059A
0945 0583 207C          LAC     SLPBUF          * LOAD PREVIOUS SLOPE VALUE.
0946 0584 007A          ADD     IFRAME
0947 0585 1074          SUB     ONE
0948 0586 6715          TBLR    SLPTMP
0949 0587 207D          LAC     SONBUF          * LOAD PREVIOUS SONOGRAM VALUE.
0950 0588 007A          ADD     IFRAME
0951 0589 1074          SUB     ONE
0952 058A 6716          TBLR    SONTMP
0953 058B 6612          ZALS    SLOPE
0954 058C 7815          XOR     SLPTMP          * TEST FOR MATCH WITH LAST WORD.
0955 058D 5015          SACL    SLPTMP
0956 058E 6614          ZALS    SONO
0957 058F 7816          XOR     SONTMP
0958 0590 7A15          OR      SLPTMP
0959 0591 FE00          BNZ     HNG1
     0592 059C
0960 0593 2074  MATCH3  LAC     ONE
0961 0594 507E          SACL    MATCH           * SET MATCH FLAG.
0962 0595 207A          LAC     IFRAME
0963 0596 1074          SUB     ONE             * DEC. FRAME COUNT.
0964 0597 507A          SACL    IFRAME
0965 0598 F900          B       HNG1
     0599 059C
0966 059A 7F89  MATCH2  ZAC
0967 059B 507E          SACL    MATCH           * CLEAR MATCH FLAG.
```

```
0968 059C 2077  HNG1   LAC     IHANG          * RETURN IF NOT IN (over)HANG SEGMENT.
0969 059D FF00         BZ      TMPRET
     059E 061D
0970 059F 7E02  HNG2   LACK    NHANG          * RETURN IF IN (over)HANG SEGMENT,
0971 05A0 1077         SUB     IHANG            BUT LESS THAN THE NHANG NUMBER.
0972 05A1 FC00         BGZ     TMPRET
     05A2 061D
0973 05A3 7E34  HNG3   LACK    FRMIN
0974 05A4 107A         SUB     IFRAME         * TEST FOR UNDERFLOW.
0975 05A5 FB00         BLEZ    REDUCE
     05A6 05AB
0976 05A7 2075         LAC     NEGONE
0977 05A8 507F         SACL    UNOVER         * SET UNOVER TO UNDER.
0978 05A9 F900         B       RESET          * IGNORE SMALL WORD
     05AA 0618
0979            *                               SEND INTERRUPT FLAG.
0980            *
0981 05AB 7F81  REDUCE DINT
0982 05AC 7E14         LACK    NEND
0983 05AD 107A         SUB     IFRAME         * BACKUP  FRAME COUNT TO END OF WORD
0984 05AE 7F88         ABS
0985 05AF 0074         ADD     ONE              COMPUTE # OF FRAMES PER BLOCK (MSIZE)
0986 05B0 507A         SACL    IFRAME           THE MAJORITY RULE THRESHOLD (M2SIZE).
0987 05B1 2C7A         LAC     IFRAME,12
0988 05B2 5818         SACH    M2SIZE
0989 05B3 5917         SACH    MSIZE,1
0990 05B4 207C         LAC     SLPBUF         * INITIALIZE REDUCTION ROUTINE
0991 05B5 5019         SACL    LL1              POINTERS.
0992 05B6 207D         LAC     SONBUF
0993 05B7 501A         SACL    LL2
0994 05B8 2374         LAC     ONE,3
0995 05B9 501D         SACL    BLKCNT         * INITIALIZE # OF BLOCKS TO 8.
0996 05BA 7E1E         LACK    TMPBUF         * LOAD  ADDRESS OF OUTPUT TEMPLATE
0997 05BB 502E         SACL    TMPLPT           BUFFER IN DRAM.
0998 05BC 6880         LARP    0
0999 05BD 2474  RLOOP1 LAC     ONE,4          * INITIALIZE BITCNT TO 16.
1000 05BE 502F         SACL    BITCNT
1001 05BF 2074         LAC     ONE            * INITIALIZE FIRST BIT MASK.
1002 05C0 5030         SACL    RMASK
1003 05C1 382E         LAR     0,TMPLPT
1004 05C2 7F89         ZAC
1005 05C3 50A0         SACL    *+,0,0         * ZERO NEW SLOPE TEMPLATE.
1006 05C4 5090         SACL    *-,0,0         * ZERO NEW SONO TEMPLATE.
1007 05C5 2017  RLOOP2 LAC     MSIZE          * INITIALIZE LOOP COUNT TO MSIZE.
1008 05C6 5031         SACL    LOOPCT
1009 05C7 7F89         ZAC
1010 05C8 5032         SACL    SUM1           * CLEAR SUM1 AND SUM2.
1011 05C9 5033         SACL    SUM2
1012 05CA 2019         LAC     LL1
1013 05CB 501B         SACL    L1
1014 05CC 201A         LAC     LL2
1015 05CD 501C         SACL    L2
1016 05CE 201B  RLOOP3 LAC     L1
1017 05CF 6715         TBLR    SLPTMP         * READ IN SLOPE SAMPLE.
1018 05D0 0074         ADD     ONE            * INC. L1 COUNT.
1019 05D1 501B         SACL    L1
1020 05D2 2015         LAC     SLPTMP
1021 05D3 7930         AND     RMASK          * MASK OFF NEW BIT.
1022 05D4 FF00         BZ      NOINC1
     05D5 05D9
1023 05D6 2032  INC1   LAC     SUM1
1024 05D7 0074         ADD     ONE            * INC. SUM1 IF ONE FOUND.
1025 05D8 5032         SACL    SUM1
1026 05D9 201C  NOINC1 LAC     L2
1027 05DA 6716         TBLR    SONTMP         * READ IN SONOGRAM SAMPLE.
1028 05DB 0074         ADD     ONE            * INC. L2 COUNT.
1029 05DC 501C         SACL    L2
1030 05DD 2016         LAC     SONTMP
1031 05DE 7930         AND     RMASK          * MASK OFF NEW BIT
1032 05DF FF00         BZ      NOINC2
     05E0 05E4
1033 05E1 2033  INC2   LAC     SUM2
1034 05E2 0074         ADD     ONE            * INC. SUM2 IF ONE FOUND.
1035 05E3 5033         SACL    SUM2
1036 05E4 2031  NOINC2 LAC     LOOPCT         * DECREMENT LOOPCT.
1037 05E5 1074         SUB     ONE
1038 05E6 5031         SACL    LOOPCT
1039 05E7 FC00         BGZ     RLOOP3
     05E8 05CE
```

```
1040 05E9 2032          LAC     SUM1            * TEST SUM1.
1041 05EA 1018          SUB     M2SIZE
1042 05EB F800          BLEZ    MOROS1
     05EC 05F0
1043 05ED 2080  MOR1S1  LAC     *,0,0           * 'ADD' NEW SLOPE TEMPLATE BIT.
1044 05EE 7A30          OR      RMASK
1045 05EF 5080          SACL    *,0,0
1046 05F0 2033  MOROS1  LAC     SUM2            * TEST SUM2.
1047 05F1 1018          SUB     M2SIZE
1048 05F2 F800          BLEZ    MOROS2
     05F3 05F8
1049 05F4 68A8  MOR1S2  MAR     *+
1050 05F5 2080          LAC     *,0,0           * 'ADD' NEW SOND TEMPLATE BIT.
1051 05F6 7A30          OR      RMASK
1052 05F7 5090          SACL    *-,0,0
1053 05F8 2130  MOROS2  LAC     RMASK,1
1054 05F9 5030          SACL    RMASK
1055 05FA 202F          LAC     BITCNT
1056 05FB 1074          SUB     ONE
1057 05FC 502F          SACL    BITCNT
1058 05FD FC00          BGZ     RLOOP2
     05FE 05C5
1059 05FF 2019          LAC     LL1
1060 0600 0017          ADD     MSIZE
1061 0601 5019          SACL    LL1
1062 0602 201A          LAC     LL2
1063 0603 0017          ADD     MSIZE
1064 0604 501A          SACL    LL2
1065 0605 202E          LAC     TMPLFT
1066 0606 0174          ADD     ONE,1
1067 0607 502E          SACL    TMPLFT
1068 0608 201D          LAC     BLKCNT
1069 0609 1074          SUB     ONE
1070 060A 501D          SACL    BLKCNT
1071 060B FC00          BGZ     RLOOP1
     060C 05BD
1072 060D 700F  OUTTMP  LARK    0,15            * SUBROUTINE TO DUMP TEMPLATE.
1073 060E 711E          LARK    1,TMPBUF
1074 060F 6881  OUTIT   LARP    1
1075 0610 48A0          OUT     *+,OUT88,0
1076 0611 F600  BIOLUP  BIOZ    INLOOP
     0612 0615
1077 0613 F900          B       BIOLUP
     0614 0611
1078 0615 4072  INLOOP  IN      INTEMP,INHR
1079 0616 F400          BANZ    OUTIT
     0617 060F
1080 0618 7F89  RESET   ZAC                     * RESET ALL VARIABLES.
1081 0619 507F          SACL    DMOVER
1082 061A 5077          SACL    IHANG
1083 061B 7E01          LACK    MPRE
1084 061C 507A          SACL    IFRAME
1085 061D 7F92  TMPRET  EINT
1086 061E 7F8D          RET
1087            *
1088            *
1089            *
1090 061F 4975  OUTPUT  OUT     NEGONE,PCMOUT   * RE-ORDER DATA & OUTPUT TO
1091 0620 4900          OUT     S001,PCMOUT     * PORT PCMOUT.
1092 0621 4901          OUT     S002,PCMOUT
1093 0622 4910          OUT     S017,PCMOUT
1094 0623 4911          OUT     S018,PCMOUT
1095 0624 4908          OUT     S009,PCMOUT
1096 0625 4909          OUT     S010,PCMOUT
1097 0626 4918          OUT     S025,PCMOUT
1098 0627 4919          OUT     S026,PCMOUT
1099 0628 4904          OUT     S005,PCMOUT
1100 0629 4905          OUT     S006,PCMOUT
1101 062A 4914          OUT     S021,PCMOUT
1102 062B 4915          OUT     S022,PCMOUT
1103 062C 490C          OUT     S013,PCMOUT
1104 062D 490D          OUT     S014,PCMOUT
1105 062E 491C          OUT     S029,PCMOUT
1106 062F 491D          OUT     S030,PCMOUT
1107 0630 4902          OUT     S003,PCMOUT
1108 0631 4903          OUT     S004,PCMOUT
1109 0632 4912          OUT     S019,PCMOUT
1110 0633 4913          OUT     S020,PCMOUT
1111 0634 490A          OUT     S011,PCMOUT
```

```
0635 490B          OUT     SO12,PCMOUT
0636 491A          OUT     SO27,PCMOUT
0637 491B          OUT     SO28,PCMOUT
0638 4906          OUT     SO07,PCMOUT
0639 4907          OUT     SO08,PCMOUT
063A 4916          OUT     SO23,PCMOUT
063B 4917          OUT     SO24,PCMOUT
063C 490E          OUT     SO15,PCMOUT
063D 490F          OUT     SO16,PCMOUT
063E 491E          OUT     SO31,PCMOUT
063F 491F          OUT     SO32,PCMOUT
0640 4975          OUT     NEGONE,PCMOUT
0641 7F8D          RET
                *
0642 4975  OUTSO   OUT     NEGONE,PCMOUT
0643 4900          OUT     SO01,PCMOUT
0644 4901          OUT     SO02,PCMOUT
0645 4902          OUT     SO03,PCMOUT
0646 4903          OUT     SO04,PCMOUT
0647 4904          OUT     SO05,PCMOUT
0648 4905          OUT     SO06,PCMOUT
0649 4906          OUT     SO07,PCMOUT
064A 4907          OUT     SO08,PCMOUT
064B 4908          OUT     SO09,PCMOUT
064C 4909          OUT     SO10,PCMOUT
064D 490A          OUT     SO11,PCMOUT
064E 490B          OUT     SO12,PCMOUT
064F 490C          OUT     SO13,PCMOUT
0650 490D          OUT     SO14,PCMOUT
0651 490E          OUT     SO15,PCMOUT
0652 490F          OUT     SO16,PCMOUT
0653 4910          OUT     SO17,PCMOUT
0654 4911          OUT     SO18,PCMOUT
0655 4912          OUT     SO19,PCMOUT
0656 4913          OUT     SO20,PCMOUT
0657 4914          OUT     SO21,PCMOUT
0658 4915          OUT     SO22,PCMOUT
0659 4916          OUT     SO23,PCMOUT
065A 4917          OUT     SO24,PCMOUT
065B 4918          OUT     SO25,PCMOUT
065C 4919          OUT     SO26,PCMOUT
065D 491A          OUT     SO27,PCMOUT
065E 491B          OUT     SO28,PCMOUT
065F 491C          OUT     SO29,PCMOUT
0660 491D          OUT     SO30,PCMOUT
0661 491E          OUT     SO31,PCMOUT
0662 491F          OUT     SO32,PCMOUT
0663 4975          OUT     NEGONE,PCMOUT
0664 7F8D          RET
                *
0665 4975  OUTSO2  OUT     NEGONE,PCMOUT
0666 4900          OUT     SO01,PCMOUT
0667 4901          OUT     SO02,PCMOUT
0668 4902          OUT     SO03,PCMOUT
0669 4903          OUT     SO04,PCMOUT
066A 4904          OUT     SO05,PCMOUT
066B 4905          OUT     SO06,PCMOUT
066C 4906          OUT     SO07,PCMOUT
066D 4907          OUT     SO08,PCMOUT
066E 4908          OUT     SO09,PCMOUT
066F 4909          OUT     SO10,PCMOUT
0670 490A          OUT     SO11,PCMOUT
0671 490B          OUT     SO12,PCMOUT
0672 490C          OUT     SO13,PCMOUT
0673 490D          OUT     SO14,PCMOUT
0674 490E          OUT     SO15,PCMOUT
0675 490F          OUT     SO16,PCMOUT
0676 4975          OUT     NEGONE,PCMOUT
0677 7F8D          RET
                *
0678 4975  OUTSE   OUT     NEGONE,PCMOUT
0679 4920          OUT     SE01,PCMOUT
067A 4921          OUT     SE02,PCMOUT
067B 4922          OUT     SE03,PCMOUT
067C 4923          OUT     SE04,PCMOUT
067D 4924          OUT     SE05,PCMOUT
067E 4925          OUT     SE06,PCMOUT
067F 4926          OUT     SE07,PCMOUT
0680 4927          OUT     SE08,PCMOUT
```

```
0681 4928          OUT     SE09,PCMOUT
0682 4929          OUT     SE10,PCMOUT
0683 492A          OUT     SE11,PCMOUT
0684 492B          OUT     SE12,PCMOUT
0685 492C          OUT     SE13,PCMOUT
0686 492D          OUT     SE14,PCMOUT
0687 492E          OUT     SE15,PCMOUT
0688 492F          OUT     SE16,PCMOUT
0689 4930          OUT     SE17,PCMOUT
068A 4931          OUT     SE18,PCMOUT
068B 4932          OUT     SE19,PCMOUT
068C 4933          OUT     SE20,PCMOUT
068D 4934          OUT     SE21,PCMOUT
068E 4935          OUT     SE22,PCMOUT
068F 4936          OUT     SE23,PCMOUT
0690 4937          OUT     SE24,PCMOUT
0691 4938          OUT     SE25,PCMOUT
0692 4939          OUT     SE26,PCMOUT
0693 493A          OUT     SE27,PCMOUT
0694 493B          OUT     SE28,PCMOUT
0695 493C          OUT     SE29,PCMOUT
0696 493D          OUT     SE30,PCMOUT
0697 493E          OUT     SE31,PCMOUT
0698 493F          OUT     SE32,PCMOUT
0699 4975          OUT     NEGOUF,PCMOUT
069A 7F9D          RET
                *
069B 2020   DDMOV  LAC     SE01,0
069C 3800          LAR     0,S001
069D 5000          SACL    S001
069E 3020          SAR     0,SE01
069F 2021          LAC     SE02,0
06A0 3801          LAR     0,S002
06A1 5001          SACL    S002
06A2 3021          SAR     0,SE02
06A3 2022          LAC     SE03,0
06A4 3802          LAR     0,S003
06A5 5002          SACL    S003
06A6 3022          SAR     0,SE03
06A7 2023          LAC     SE04,0
06A8 3803          LAR     0,S004
06A9 5003          SACL    S004
06AA 3023          SAR     0,SE04
06AB 2024          LAC     SE05,0
06AC 3804          LAR     0,S005
06AD 5004          SACL    S005
06AE 3024          SAR     0,SE05
06AF 2025          LAC     SE06,0
06B0 3805          LAR     0,S006
06B1 5005          SACL    S006
06B2 3025          SAR     0,SE06
06B3 2026          LAC     SE07,0
06B4 3806          LAR     0,S007
06B5 5006          SACL    S007
06B6 3026          SAR     0,SE07
06B7 2027          LAC     SE08,0
06B8 3807          LAR     0,S008
06B9 5007          SACL    S008
06BA 3027          SAR     0,SE08
06BB 2028          LAC     SE09,0
06BC 3808          LAR     0,S009
06BD 5008          SACL    S009
06BE 3028          SAR     0,SE09
06BF 2029          LAC     SE10,0
06C0 3809          LAR     0,S010
06C1 5009          SACL    S010
06C2 3029          SAR     0,SE10
06C3 202A          LAC     SE11,0
06C4 380A          LAR     0,S011
06C5 500A          SACL    S011
06C6 302A          SAR     0,SE11
06C7 202B          LAC     SE12,0
06C8 380B          LAR     0,S012
06C9 500B          SACL    S012
06CA 302B          SAR     0,SE12
06CB 202C          LAC     SE13,0
06CC 380C          LAR     0,S013
06CD 500C          SACL    S013
06CE 302C          SAR     0,SE13
```

```
06CF 202D        LAC     SE14,0
06D0 380D        LAR     0,S014
06D1 500D        SACL    S014
06D2 302D        SAR     0,SE14
06D3 202E        LAC     SE15,0
06D4 380E        LAR     0,S015
06D5 500E        SACL    S015
06D6 302E        SAR     0,SE15
06D7 202F        LAC     SE16,0
06D8 380F        LAR     0,S016
06D9 500F        SACL    S016
06DA 302F        SAR     0,SE16
06DB 2030        LAC     SE17,0
06DC 3810        LAR     0,S017
06DD 5010        SACL    S017
06DE 3030        SAR     0,SE17
06DF 2031        LAC     SE18,0
06E0 3811        LAR     0,S018
06E1 5011        SACL    S018
06E2 3031        SAR     0,SE18
06E3 2032        LAC     SE19,0
06E4 3812        LAR     0,S019
06E5 5012        SACL    S019
06E6 3032        SAR     0,SE19
06E7 2033        LAC     SE20,0
06E8 3813        LAR     0,S020
06E9 5013        SACL    S020
06EA 3033        SAR     0,SE20
06EB 2034        LAC     SE21,0
06EC 3814        LAR     0,S021
06ED 5014        SACL    S021
06EE 3034        SAR     0,SE21
06EF 2035        LAC     SE22,0
06F0 3815        LAR     0,S022
06F1 5015        SACL    S022
06F2 3035        SAR     0,SE22
06F3 2036        LAC     SE23,0
06F4 3816        LAR     0,S023
06F5 5016        SACL    S023
06F6 3036        SAR     0,SE23
06F7 2037        LAC     SE24,0
06F8 3817        LAR     0,S024
06F9 5017        SACL    S024
06FA 3037        SAR     0,SE24
06FB 2038        LAC     SE25,0
06FC 3818        LAR     0,S025
06FD 5018        SACL    S025
06FE 3038        SAR     0,SE25
06FF 2039        LAC     SE26,0
0700 3819        LAR     0,S026
0701 5019        SACL    S026
0702 3039        SAR     0,SE26
0703 203A        LAC     SE27,0
0704 381A        LAR     0,S027
0705 501A        SACL    S027
0706 303A        SAR     0,SE27
0707 203B        LAC     SE28,0
0708 381B        LAR     0,S028
0709 501B        SACL    S028
070A 303B        SAR     0,SE28
070B 203C        LAC     SE29,0
070C 381C        LAR     0,S029
070D 501C        SACL    S029
070E 303C        SAR     0,SE29
070F 203D        LAC     SE30,0
0710 381D        LAR     0,S030
0711 501D        SACL    S030
0712 303D        SAR     0,SE30
0713 203E        LAC     SE31,0
0714 381E        LAR     0,S031
0715 501E        SACL    S031
0716 303E        SAR     0,SE31
0717 203F        LAC     SE32,0
0718 381F        LAR     0,S032
0719 501F        SACL    S032
071A 303F        SAR     0,SE32
071B 7F8D        RET
                 *
                 *
```

```
1349                *
1350 071C 703D  AVERAG LARK    0,SE30          * AVERAGE EVEN & ODD PARTS.
1351 071D 711D         LARK    1,S030
1352 071E 6891         LARP    1
1353 071F 2F80  FLOOP1 LAC     *,15,0
1354 0720 0F80         ADD     *,15,0
1355 0721 5891         SACH    *-,0,1
1356 0722 F400         BANZ    FLOOP1
     0723 071F
1357 0724 7F8D         RET
1358                *
1359 0725 2030  MERGE  LAC     SE17            * MERGE 32 BANDS INTO 16 BANDS
1360 0726 5000         SACL    S001              AND FILTER w/1st ORDER IIR.
1361 0727 2031         LAC     SE18
1362 0728 5001         SACL    S002
1363 0729 2028         LAC     SE09
1364 072A 5002         SACL    S003
1365 072B 2029         LAC     SE10
1366 072C 5003         SACL    S004
1367 072D 2038         LAC     SE25
1368 072E 5004         SACL    S005
1369 072F 2039         LAC     SE26
1370 0730 5005         SACL    S006
1371 0731 2024         LAC     SE05
1372 0732 5006         SACL    S007
1373 0733 2025         LAC     SE06
1374 0734 5007         SACL    S008
1375 0735 2034         LAC     SE21
1376 0736 0035         ADD     SE22
1377 0737 5008         SACL    S009
1378 0738 202C         LAC     SE13
1379 0739 002D         ADD     SE14
1380 073A 5009         SACL    S010
1381 073B 203C         LAC     SE29
1382 073C 003D         ADD     SE30
1383 073D 500A         SACL    S011
1384 073E 2022         LAC     SE03
1385 073F 0023         ADD     SE04
1386 0740 500B         SACL    S012
1387 0741 2032         LAC     SE19
1388 0742 0033         ADD     SE20
1389 0743 500C         SACL    S013
1390 0744 202A         LAC     SE11
1391 0745 002B         ADD     SE12
1392 0746 500D         SACL    S014
1393 0747 203A         LAC     SE27
1394 0748 003B         ADD     SE28
1395 0749 0026         ADD     SE07
1396 074A 500E         SACL    S015
1397 074B 2027         LAC     SE08
1398 074C 0036         ADD     SE23
1399 074D 0037         ADD     SE24
1400 074E 500F         SACL    S016
1401 074F 7F8D         RET
1402                *
1403 0750 700F  IIR    LARK    0,S016          * 1st ORDER IIR FILTER OF FRAME
1404 0751 7162         LARK    1,MEM16           SAMPLES.
1405 0752 6880         LARP    0
1406 0753 2F81  FLOOP2 LAC     *,15,1          * LOAD NEW SAMPLE
1407 0754 0F81         ADD     *,15,1          * ADD ASSOCIATED MEMORY VALUE.
1408 0755 5890         SACH    *-,0,0          * UPDATE MEMORY VALUE.
1409 0756 5980         SACH    *,1,0           * STORE FILTERED SAMPLE.
1410 0757 F400         BANZ    FLOOP2
     0758 0753
1411 0759 7F8D         RET
1412                *
1413 075A 7000  BANDOT LARK    0,S001          * SUBROUTINE TO OUTPUT
1414 075B 710F         LARK    1,15              BAND DATA FOR DEBUG.
1415 075C 6880  BLOOP  LARP    0
1416 075D 48A1         OUT     *+,OUTBB,1
1417 075E F600         BIOZ    $+4
     075F 0762
1418 0760 F900         B       $-2
     0761 075E
1419 0762 4072         IN      INTEMP,INBB
1420 0763 F400         BANZ    BLOOP
     0764 075C
1421 0765 7F8D         RET
1422                *
```

```
1423 0766 7001  ENERGY LARK    0,S002          * SUBROUTINE TO COMPUTE THE ENERGY
1424 0767 710E         LARK    1,14            * IN EACH FRAME.
1425 0768 2000         LAC     S001
1426 0769 6880  ELOOP  LARP    0
1427 076A 00A1         ADD     *+,0,1
1428 076B F400         BANZ    ELOOP
     076C 0769
1429 076D 5010         SACL    ENERGL
1430 076E 5811         SACH    ENERGH
1431 076F 7F8D         RET
1432            *
1433 0770 7F89  BINENC ZAC
1434 0771 5012         SACL    SLOPE           * CLEAR SLOPE FRAME WORD.
1435 0772 7000         LARK    0,S001
1436 0773 710F         LARK    1,14
1437 0774 6880  BLOOP1 LARP    0
1438 0775 20A0         LAC     *+,0,0          * LOAD BAND(I).
1439 0776 1081         SUB     *,0,1           * SUBTRACT BAND(I+1).
1440 0777 FA00         BLZ     BONE
     0778 077D
1441 0779 2112  BZERO  LAC     SLOPE,1         * LEFT SHIFT.
1442 077A 5012         SACL    SLOPE
1443 077B F900         B       BTEST
     077C 0780
1444 077D 2112  BONE   LAC     SLOPE,1         * LEFT SHIFT & OR W/ A ONE.
1445 077E 7A74         OR      ONE
1446 077F 5012         SACL    SLOPE
1447 0780 F400  BTEST  BANZ    BLOOP1
     0781 0774
1448 0782 2112         LAC     SLOPE,1         * LEFT JUSTIFY OUTPUT WORD.
1449 0783 5012         SACL    SLOPE
1450            *
1451 0784 6511         ZALH    ENERGH
1452 0785 7A10         OR      ENERGL
1453 0786 1079         SUB     THRESH
1454 0787 FA00         BLZ     AVE             * LSB UNCHANGED = 0
     0788 078C
1455 0789 2012         LAC     SLOPE
1456 078A 7A74         OR      ONE
1457 078B 5012         SACL    SLOPE           * LSB = 1
1458            *
1459 078C 2C10  AVE    LAC     ENERGL,12       * DIVIDE TOTAL ENERGY BY 16
1460 078D 5813         SACH    MEAN            * TO GET ,AVERAGE ENERGY' IN
1461 078E 2C75         LAC     NEGONE,12       * EACH BAND.
1462 078F 7875         XOR     NEGONE
1463 0790 7913         AND     MEAN
1464 0791 5013         SACL    MEAN
1465 0792 2C11         LAC     ENERGH,12
1466 0793 7A13         OR      MEAN
1467 0794 5013         SACL    MEAN
1468            *
1469 0795 7F89  SONOGM ZAC
1470 0796 5014         SACL    SONO            * ZERO SONOGRAM FRAME WORD.
1471 0797 7000         LARK    0,S001
1472 0798 710F         LARK    1,15
1473 0799 6880  BLOOP2 LARP    0
1474 079A 20A1         LAC     *+,0,1
1475 079B 1013         SUB     MEAN
1476 079C FA00         BLZ     SZERO
     079D 07A3
1477 079E 2114  SONE   LAC     SONO,1
1478 079F 7A74         OR      ONE
1479 07A0 5014         SACL    SONO
1480 07A1 F900         B       STEST
     07A2 07A5
1481 07A3 2114  SZERO  LAC     SONO,1
1482 07A4 5014         SACL    SONO
1483 07A5 F400  STEST  BANZ    BLOOP2
     07A6 0799
1484 07A7 7F8D         RET
1485            *
1486 07A8 4975  OUTBIN OUT     NEGONE,PCMOUT
1487 07A9 4912         OUT     SLOPE,PCMOUT
1488 07AA 4975         OUT     NEGONE,PCMOUT
1489 07AB 4914         OUT     SONO,PCMOUT
1490 07AC 4975         OUT     NEGONE,PCMOUT
1491 07AD 7F8D         RET
1492            *
1493            *
```

```
1494                *       ******* DEFINE DATA BUFFERS IN PRAM ********
1495                *
1496                *       64 LOCATIONS  : INPUT DATA BUFFER #1.
1497 07AF           PBUF1   BSS     64
1498       07ED     PBUF1E  EQU     $-1
1499                *
1500                *       64 LOCATIONS  : INPUT DATA BUFFER #2.
1501 07EE           PBUF2   BSS     64
1502       082D     PBUF2E  EQU     $-1
1503                *
1504                *       512 LOCATIONS : 32 MODULE DELAY DATA BUFFERS (ea. 16 WORDS
1505       082E     PMOD    EQU     $
1506                *
1507                ********* BEGINNING OF MODULE DELAY DATA BUFFERS************
1508                *
1509                *                       MODULE # 0
1510                *
1511 082E FFA0      A000    DATA      -96     NUM COEF. A0
1512 082F E720      A001    DATA    -6368     NUM COEF. A1
1513 0830 54A6      A002    DATA    21670     NUM COEF. A2
1514 0831 E7FB      A003    DATA    -6149     NUM COEF. A3
1515 0832 FD48      B000    DATA     -696     NUM COEF. B0
1516 0833 411E      B001    DATA    16670     NUM COEF. B1
1517 0834 C008      B002    DATA   -16376     NUM COEF. B2
1518 0835 0271      B003    DATA      625     NUM COEF. B3
1519 0836 0000              DATA        0     \
1520 0837 0000              DATA        0     :
1521 0838 0000              DATA        0     :
1522 0839 0000              DATA        0      >  DELAY CHAIN STORAGE
1523 083A 0000              DATA        0     :
1524 083B 0000              DATA        0     :
1525 083C 0000              DATA        0     :
1526 083D 0000              DATA        0     /
1527                *
1528                *                       MODULE # 1
1529                *
1530 083E FFF0      A010    DATA      -16     NUM COEF. A0
1531 083F E5CF      A011    DATA    -6705     NUM COEF. A1
1532 0840 54A3      A012    DATA    21667     NUM COEF. A2
1533 0841 E91A      A013    DATA    -5862     NUM COEF. A3
1534 0842 FCFD      B010    DATA     -771     NUM COEF. B0
1535 0843 423E      B011    DATA    16958     NUM COEF. B1
1536 0844 C133      B012    DATA   -16077     NUM COEF. B2
1537 0845 022F      B013    DATA      559     NUM COEF. B3
1538 0846 0000              DATA        0     \
1539 0847 0000              DATA        0     :
1540 0848 0000              DATA        0     :
1541 0849 0000              DATA        0      >  DELAY CHAIN STORAGE
1542 084A 0000              DATA        0     :
1543 084B 0000              DATA        0     :
1544 084C 0000              DATA        0     :
1545 084D 0000              DATA        0     /
1546                *
1547                *                       MODULE # 2
1548                *
1549 084E FFF0      A020    DATA      -16     NUM COEF. A0
1550 084F E4A8      A021    DATA    -7000     NUM COEF. A1
1551 0850 548D      A022    DATA    21645     NUM COEF. A2
1552 0851 EA2B      A023    DATA    -5589     NUM COEF. A3
1553 0852 FCAB      B020    DATA     -853     NUM COEF. B0
1554 0853 4357      B021    DATA    17239     NUM COEF. B1
1555 0854 C263      B022    DATA   -15773     NUM COEF. B2
1556 0855 01F3      B023    DATA      499     NUM COEF. B3
1557 0856 0000              DATA        0     \
1558 0857 0000              DATA        0     :
1559 0858 0000              DATA        0     :
1560 0859 0000              DATA        0      >  DELAY CHAIN STORAGE
1561 085A 0000              DATA        0     :
1562 085B 0000              DATA        0     :
1563 085C 0000              DATA        0     :
1564 085D 0000              DATA        0     /
1565                *
1566                *                       MODULE # 3
1567                *
1568 085E FFEF      A030    DATA      -17     NUM COEF. A0
1569 085F E37C      A031    DATA    -7300     NUM COEF. A1
1570 0860 546C      A032    DATA    21612     NUM COEF. A2
1571 0861 EB36      A033    DATA    -5322     NUM COEF. A3
1572 0862 FC54      B030    DATA     -940     NUM COEF. B0
```

```
0863 446B  B031   DATA   17515    NUM COEF. B1
0864 C398  B032   DATA  -15464    NUM COEF. B2
0865 018B  B033   DATA     443    NUM COEF. B3
0866 0000         DATA       0    \
0867 0000         DATA       0    :
0868 0000         DATA       0    :
0869 0000         DATA       0    >  DELAY CHAIN STORAGE
086A 0000         DATA       0    :
086B 0000         DATA       0    :
086C 0000         DATA       0    :
086D 0000         DATA       0    /
          *
          *                MODULE # 4
          *
086E FFEF  A040   DATA     -17    NUM COEF. A0
086F E24B  A041   DATA   -7605    NUM COEF. A1
0870 5440  A042   DATA   21568    NUM COEF. A2
0871 EC3B  A043   DATA   -5061    NUM COEF. A3
0872 FBF7  B040   DATA   -1033    NUM COEF. B0
0873 4578  B041   DATA   17784    NUM COEF. B1
0874 C4D2  B042   DATA  -15150    NUM COEF. B2
0875 0187  B043   DATA     391    NUM COEF. B3
0876 0000         DATA       0    \
0877 0000         DATA       0    :
0878 0000         DATA       0    :
0879 0000         DATA       0    >  DELAY CHAIN STORAGE
087A 0000         DATA       0    :
087B 0000         DATA       0    :
087C 0000         DATA       0    :
087D 0000         DATA       0    /
          *
          *                MODULE # 5
          *
087E FFF0  A050   DATA     -16    NUM COEF. A0
087F E115  A051   DATA   -7915    NUM COEF. A1
0880 540A  A052   DATA   21514    NUM COEF. A2
0881 ED38  A053   DATA   -4808    NUM COEF. A3
0882 FB95  B050   DATA   -1131    NUM COEF. B0
0883 467D  B051   DATA   18045    NUM COEF. B1
0884 C60F  B052   DATA  -14833    NUM COEF. B2
0885 0158  B053   DATA     344    NUM COEF. B3
0886 0000         DATA       0    \
0887 0000         DATA       0    :
0888 0000         DATA       0    :
0889 0000         DATA       0    >  DELAY CHAIN STORAGE
088A 0000         DATA       0    :
088B 0000         DATA       0    :
088C 0000         DATA       0    :
088D 0000         DATA       0    /
          *
          *                MODULE # 6
          *
088E FFF1  A060   DATA     -15    NUM COEF. A0
088F DFDC  A061   DATA   -8228    NUM COEF. A1
0890 53C8  A062   DATA   21448    NUM COEF. A2
0891 EE30  A063   DATA   -4560    NUM COEF. A3
0892 FB2C  B060   DATA   -1236    NUM COEF. B0
0893 477C  B061   DATA   18300    NUM COEF. B1
0894 C750  B062   DATA  -14512    NUM COEF. B2
0895 012C  B063   DATA     300    NUM COEF. B3
0896 0000         DATA       0    \
0897 0000         DATA       0    :
0898 0000         DATA       0    :
0899 0000         DATA       0    >  DELAY CHAIN STORAGE
089A 0000         DATA       0    :
089B 0000         DATA       0    :
089C 0000         DATA       0    :
089D 0000         DATA       0    /
          *
          *                MODULE # 7
          *
089E FFF4  A070   DATA     -12    NUM COEF. A0
089F DE9E  A071   DATA   -8546    NUM COEF. A1
08A0 537C  A072   DATA   21372    NUM COEF. A2
08A1 EF20  A073   DATA   -4320    NUM COEF. A3
08A2 FABC  B070   DATA   -1348    NUM COEF. B0
08A3 4872  B071   DATA   18546    NUM COEF. B1
08A4 C895  B072   DATA  -14187    NUM COEF. B2
08A5 0105  B073   DATA     261    NUM COEF. B3
```

```
08A6 0000          DATA      0      \
08A7 0000          DATA      0      :
08A8 0000          DATA      0      :
08A9 0000          DATA      0      >  DELAY CHAIN STORAGE
08AA 0000          DATA      0      :
08AB 0000          DATA      0      :
08AC 0000          DATA      0      :
08AD 0000          DATA      0      /
            *
            *                    MODULE # 8
            *
08AE FFF6  A080    DATA     -10     NUM COEF. A0
08AF DD5D  A081    DATA   -8867     NUM COEF. A1
08B0 5325  A082    DATA   21285     NUM COEF. A2
08B1 F009  A083    DATA   -4087     NUM COEF. A3
08B2 FA46  B080    DATA   -1466     NUM COEF. B0
08B3 4961  B081    DATA   18785     NUM COEF. B1
08B4 C9DC  B082    DATA  -13860     NUM COEF. B2
08B5 00E1  B083    DATA     225     NUM COEF. B3
08B6 0000          DATA      0      \
08B7 0000          DATA      0      :
08B8 0000          DATA      0      :
08B9 0000          DATA      0      >  DELAY CHAIN STORAGE
08BA 0000          DATA      0      :
08BB 0000          DATA      0      :
08BC 0000          DATA      0      :
08BD 0000          DATA      0      /
            *
            *                    MODULE # 9
            *
08BE FFFA  A090    DATA      -6     NUM COEF. A0
08BF DC19  A091    DATA   -9191     NUM COEF. A1
08C0 52C4  A092    DATA   21188     NUM COEF. A2
08C1 F0EB  A093    DATA   -3861     NUM COEF. A3
08C2 F9CA  B090    DATA   -1590     NUM COEF. B0
08C3 4A48  B091    DATA   19016     NUM COEF. B1
08C4 CB26  B092    DATA  -13530     NUM COEF. B2
08C5 00C1  B093    DATA     193     NUM COEF. B3
08C6 0000          DATA      0      \
08C7 0000          DATA      0      :
08C8 0000          DATA      0      :
08C9 0000          DATA      0      >  DELAY CHAIN STORAGE
08CA 0000          DATA      0      :
08CB 0000          DATA      0      :
08CC 0000          DATA      0      :
08CD 0000          DATA      0      /
            *
            *                    MODULE #10
            *
08CE FFFF  A0A0    DATA      -1     NUM COEF. A0
08CF DAD2  A0A1    DATA   -9518     NUM COEF. A1
08D0 5258  A0A2    DATA   21080     NUM COEF. A2
08D1 F1C5  A0A3    DATA   -3643     NUM COEF. A3
08D2 F946  B0A0    DATA   -1722     NUM COEF. B0
08D3 4B27  B0A1    DATA   19239     NUM COEF. B1
08D4 CC72  B0A2    DATA  -13198     NUM COEF. B2
08D5 00A3  B0A3    DATA     163     NUM COEF. B3
08D6 0000          DATA      0      \
08D7 0000          DATA      0      :
08D8 0000          DATA      0      :
08D9 0000          DATA      0      >  DELAY CHAIN STORAGE
08DA 0000          DATA      0      :
08DB 0000          DATA      0      :
08DC 0000          DATA      0      :
08DD 0000          DATA      0      /
            *
            *                    MODULE #11
            *
08DE 0005  A0B0    DATA       5     NUM COEF. A0
08DF D988  A0B1    DATA   -9848     NUM COEF. A1
08E0 51E2  A0B2    DATA   20962     NUM COEF. A2
08E1 F299  A0B3    DATA   -3431     NUM COEF. A3
08E2 F84C  B0B0    DATA   -1860     NUM COEF. B0
08E3 4BFD  B0B1    DATA   19453     NUM COEF. B1
08E4 CD3F  B0B2    DATA  -12865     NUM COEF. B2
08E5 0039  B0B3    DATA     137     NUM COEF. B3
08E6 0000          DATA      0      \
08E7 0000          DATA      0      :
08E8 0000          DATA      0      :
```

```
1731 08E9 0000            DATA        0      >  DELAY CHAIN STORAGE
1732 08EA 0000            DATA        0      :
1733 08EB 0000            DATA        0      :
1734 08EC 0000            DATA        0      :
1735 08ED 0000            DATA        0      /
1736              *
1737              *                   MODULE #12
1738              *
1739 08EE 000D  A0C0      DATA       13      NUM COEF. A0
1740 08EF D83C  A0C1      DATA   -10180      NUM COEF. A1
1741 08F0 5161  A0C2      DATA    20833      NUM COEF. A2
1742 08F1 F365  A0C3      DATA    -3227      NUM COEF. A3
1743 08F2 F82A  B0C0      DATA    -2006      NUM COEF. B0
1744 08F3 4CCA  B0C1      DATA    19658      NUM COEF. B1
1745 08F4 CF0E  B0C2      DATA   -12530      NUM COEF. B2
1746 08F5 0072  B0C3      DATA      114      NUM COEF. B3
1747 08F6 0000            DATA        0      \
1748 08F7 0000            DATA        0      :
1749 08F8 0000            DATA        0      :
1750 08F9 0000            DATA        0      >  DELAY CHAIN STORAGE
1751 08FA 0000            DATA        0      :
1752 08FB 0000            DATA        0      :
1753 08FC 0000            DATA        0      :
1754 08FD 0000            DATA        0      /
1755              *
1756              *                   MODULE #13
1757              *
1758 08FE 0015  A0D0      DATA       21      NUM COEF. A0
1759 08FF D6EF  A0D1      DATA   -10513      NUM COEF. A1
1760 0900 5007  A0D2      DATA    20695      NUM COEF. A2
1761 0901 F429  A0D3      DATA    -3031      NUM COEF. A3
1762 0902 F792  B0D0      DATA    -2158      NUM COEF. B0
1763 0903 4D8F  B0D1      DATA    19855      NUM COEF. B1
1764 0904 D05E  B0D2      DATA   -12194      NUM COEF. B2
1765 0905 005D  B0D3      DATA       93      NUM COEF. B3
1766 0906 0000            DATA        0      \
1767 0907 0000            DATA        0      :
1768 0908 0000            DATA        0      :
1769 0909 0000            DATA        0      >  DELAY CHAIN STORAGE
1770 090A 0000            DATA        0      :
1771 090B 0000            DATA        0      :
1772 090C 0000            DATA        0      :
1773 090D 0000            DATA        0      /
1774              *
1775              *                   MODULE #14
1776              *
1777 090E 0020  A0E0      DATA       32      NUM COEF. A0
1778 090F D5A0  A0E1      DATA   -10848      NUM COEF. A1
1779 0910 5042  A0E2      DATA    20546      NUM COEF. A2
1780 0911 F4E7  A0E3      DATA    -2841      NUM COEF. A3
1781 0912 F6F2  B0E0      DATA    -2318      NUM COEF. B0
1782 0913 4E4A  B0E1      DATA    20042      NUM COEF. B1
1783 0914 D1AF  B0E2      DATA   -11857      NUM COEF. B2
1784 0915 004A  B0E3      DATA       74      NUM COEF. B3
1785 0916 0000            DATA        0      \
1786 0917 0000            DATA        0      :
1787 0918 0000            DATA        0      :
1788 0919 0000            DATA        0      >  DELAY CHAIN STORAGE
1789 091A 0000            DATA        0      :
1790 091B 0000            DATA        0      :
1791 091C 0000            DATA        0      :
1792 091D 0000            DATA        0      /
1793              *
1794              *                   MODULE #15
1795              *
1796 091E 002C  A0F0      DATA       44      NUM COEF. A0
1797 091F D450  A0F1      DATA   -11184      NUM COEF. A1
1798 0920 4FA4  A0F2      DATA    20388      NUM COEF. A2
1799 0921 F59C  A0F3      DATA    -2660      NUM COEF. A3
1800 0922 F64B  B0F0      DATA    -2485      NUM COEF. B0
1801 0923 4EFB  B0F1      DATA    20219      NUM COEF. B1
1802 0924 D300  B0F2      DATA   -11520      NUM COEF. B2
1803 0925 003A  B0F3      DATA       58      NUM COEF. B3
1804 0926 0000            DATA        0      \
1805 0927 0000            DATA        0      :
1806 0928 0000            DATA        0      :
1807 0929 0000            DATA        0      >  DELAY CHAIN STORAGE
1808 092A 0000            DATA        0      :
1809 092B 0000            DATA        0      :
```

```
092C 0000          DATA      0      :
092D 0000          DATA      0      /
            *
            *                MODULE #16
            *
092E 003A  A100    DATA     58      NUM COEF. A0
092F D300  A101    DATA    -11520   NUM COEF. A1
0930 4EFB  A102    DATA     20219   NUM COEF. A2
0931 F64B  A103    DATA     -2485   NUM COEF. A3
0932 F59C  B100    DATA     -2660   NUM COEF. B0
0933 4FA4  B101    DATA     20388   NUM COEF. B1
0934 D450  B102    DATA    -11184   NUM COEF. B2
0935 002C  B103    DATA     44      NUM COEF. B3
0936 0000          DATA      0      \
0937 0000          DATA      0      :
0938 0000          DATA      0      :
0939 0000          DATA      0       >  DELAY CHAIN STORAGE
093A 0000          DATA      0      :
093B 0000          DATA      0      :
093C 0000          DATA      0      :
093D 0000          DATA      0      /
            *
            *                MODULE #17
            *
093E 004A  A110    DATA     74      NUM COEF. A0
093F D1AF  A111    DATA    -11857   NUM COEF. A1
0940 4E4A  A112    DATA     20042   NUM COEF. A2
0941 F6F2  A113    DATA     -2318   NUM COEF. A3
0942 F4E7  B110    DATA     -2841   NUM COEF. B0
0943 5042  B111    DATA     20546   NUM COEF. B1
0944 D5A0  B112    DATA    -10848   NUM COEF. B2
0945 0020  B113    DATA     32      NUM COEF. B3
0946 0000          DATA      0      \
0947 0000          DATA      0      :
0948 0000          DATA      0      :
0949 0000          DATA      0       >  DELAY CHAIN STORAGE
094A 0000          DATA      0      :
094B 0000          DATA      0      :
094C 0000          DATA      0      :
094D 0000          DATA      0      /
            *
            *                MODULE #18
            *
094E 005D  A120    DATA     93      NUM COEF. A0
094F D05E  A121    DATA    -12194   NUM COEF. A1
0950 4D8F  A122    DATA     19855   NUM COEF. A2
0951 F792  A123    DATA     -2158   NUM COEF. A3
0952 F429  B120    DATA     -3031   NUM COEF. B0
0953 5007  B121    DATA     20695   NUM COEF. B1
0954 D6EF  B122    DATA    -10513   NUM COEF. B2
0955 0015  B123    DATA     21      NUM COEF. B3
0956 0000          DATA      0      \
0957 0000          DATA      0      :
0958 0000          DATA      0      :
0959 0000          DATA      0       >  DELAY CHAIN STORAGE
095A 0000          DATA      0      :
095B 0000          DATA      0      :
095C 0000          DATA      0      :
095D 0000          DATA      0      /
            *
            *                MODULE #19
            *
095E 0072  A130    DATA    114      NUM COEF. A0
095F CF0E  A131    DATA    -12530   NUM COEF. A1
0960 4CCA  A132    DATA     19658   NUM COEF. A2
0961 F82A  A133    DATA     -2006   NUM COEF. A3
0962 F365  B130    DATA     -3227   NUM COEF. B0
0963 5161  B131    DATA     20833   NUM COEF. B1
0964 D83C  B132    DATA    -10180   NUM COEF. B2
0965 000D  B133    DATA     13      NUM COEF. B3
0966 0000          DATA      0      \
0967 0000          DATA      0      :
0968 0000          DATA      0      :
0969 0000          DATA      0       >  DELAY CHAIN STORAGE
096A 0000          DATA      0      :
096B 0000          DATA      0      :
096C 0000          DATA      0      :
096D 0000          DATA      0      /
            *
```

```
1889                *                          MODULE #20
1890                *
1891 096E 0089  A140      DATA        137      NUM COEF. A0
1892 096F CDBF  A141      DATA     -12865      NUM COEF. A1
1893 0970 48FD  A142      DATA      19453      NUM COEF. A2
1894 0971 F8BC  A143      DATA      -1860      NUM COEF. A3
1895 0972 F299  B140      DATA      -3431      NUM COEF. B0
1896 0973 51E2  B141      DATA      20962      NUM COEF. B1
1897 0974 D988  B142      DATA      -9848      NUM COEF. B2
1898 0975 0005  B143      DATA          5      NUM COEF. B3
1899 0976 0000            DATA          0      \
1900 0977 0000            DATA          0      :
1901 0978 0000            DATA          0      :
1902 0979 0000            DATA          0      >  DELAY CHAIN STORAGE
1903 097A 0000            DATA          0      :
1904 097B 0000            DATA          0      :
1905 097C 0000            DATA          0      :
1906 097D 0000            DATA          0      /
1907                *
1908                *                          MODULE #21
1909                *
1910 097E 00A3  A150      DATA        163      NUM COEF. A0
1911 097F CC72  A151      DATA     -13198      NUM COEF. A1
1912 0980 4B27  A152      DATA      19239      NUM COEF. A2
1913 0981 F946  A153      DATA      -1722      NUM COEF. A3
1914 0982 F1C5  B150      DATA      -3643      NUM COEF. B0
1915 0983 5258  B151      DATA      21080      NUM COEF. B1
1916 0984 DAD2  B152      DATA      -9518      NUM COEF. B2
1917 0985 FFFF  B153      DATA         -1      NUM COEF. B3
1918 0986 0000            DATA          0      \
1919 0987 0000            DATA          0      :
1920 0988 0000            DATA          0      :
1921 0989 0000            DATA          0      >  DELAY CHAIN STORAGE
1922 098A 0000            DATA          0      :
1923 098B 0000            DATA          0      :
1924 098C 0000            DATA          0      :
1925 098D 0000            DATA          0      /
1926                *
1927                *                          MODULE #22
1928                *
1929 098E 00C1  A160      DATA        193      NUM COEF. A0
1930 098F CB26  A161      DATA     -13530      NUM COEF. A1
1931 0990 4A48  A162      DATA      19016      NUM COEF. A2
1932 0991 F9CA  A163      DATA      -1590      NUM COEF. A3
1933 0992 F0EB  B160      DATA      -3861      NUM COEF. B0
1934 0993 52C4  B161      DATA      21188      NUM COEF. B1
1935 0994 DC19  B162      DATA      -9191      NUM COEF. B2
1936 0995 FFFA  B163      DATA         -6      NUM COEF. B3
1937 0996 0000            DATA          0      \
1938 0997 0000            DATA          0      :
1939 0998 0000            DATA          0      :
1940 0999 0000            DATA          0      >  DELAY CHAIN STORAGE
1941 099A 0000            DATA          0      :
1942 099B 0000            DATA          0      :
1943 099C 0000            DATA          0      :
1944 099D 0000            DATA          0      /
1945                *
1946                *                          MODULE #23
1947                *
1948 099E 00E1  A170      DATA        225      NUM COEF. A0
1949 099F C9DC  A171      DATA     -13860      NUM COEF. A1
1950 09A0 4961  A172      DATA      18785      NUM COEF. A2
1951 09A1 FA46  A173      DATA      -1466      NUM COEF. A3
1952 09A2 F009  B170      DATA      -4087      NUM COEF. B0
1953 09A3 5325  B171      DATA      21285      NUM COEF. B1
1954 09A4 DD5D  B172      DATA      -8867      NUM COEF. B2
1955 09A5 FFF6  B173      DATA        -10      NUM COEF. B3
1956 09A6 0000            DATA          0      \
1957 09A7 0000            DATA          0      :
1958 09A8 0000            DATA          0      :
1959 09A9 0000            DATA          0      >  DELAY CHAIN STORAGE
1960 09AA 0000            DATA          0      :
1961 09AB 0000            DATA          0      :
1962 09AC 0000            DATA          0      :
1963 09AD 0000            DATA          0      /
1964                *
1965                *                          MODULE #24
1966                *
1967 09AE 0105  A180      DATA        261      NUM COEF. A0
```

```
1968 09AF C895  A181     DATA    -14187     NUM COEF. A1
1969 09B0 4872  A182     DATA     18546     NUM COEF. A2
1970 09B1 FA8C  A183     DATA     -1348     NUM COEF. A3
1971 09B2 EF20  B180     DATA     -4320     NUM COEF. B0
1972 09B3 537C  B181     DATA     21372     NUM COEF. B1
1973 09B4 DE9E  B182     DATA     -8546     NUM COEF. B2
1974 09B5 FFF4  B183     DATA       -12     NUM COEF. B3
1975 09B6 0000           DATA         0      \
1976 09B7 0000           DATA         0      :
1977 09B8 0000           DATA         0      :
1978 09B9 0000           DATA         0       >  DELAY CHAIN STORAGE
1979 09BA 0000           DATA         0      :
1980 09BB 0000           DATA         0      :
1981 09BC 0000           DATA         0      :
1982 09BD 0000           DATA         0      /
1983            *
1984            *                    MODULE #25
1985            *
1986 09BE 012C  A190     DATA       300     NUM COEF. A0
1987 09BF C750  A191     DATA    -14512     NUM COEF. A1
1988 09C0 477C  A192     DATA     18300     NUM COEF. A2
1989 09C1 FB2C  A193     DATA     -1236     NUM COEF. A3
1990 09C2 EE30  B190     DATA     -4560     NUM COEF. B0
1991 09C3 53C8  B191     DATA     21448     NUM COEF. B1
1992 09C4 DFDC  B192     DATA     -8228     NUM COEF. B2
1993 09C5 FFF1  B193     DATA       -15     NUM COEF. B3
1994 09C6 0000           DATA         0      \
1995 09C7 0000           DATA         0      :
1996 09C8 0000           DATA         0      :
1997 09C9 0000           DATA         0       >  DELAY CHAIN STORAGE
1998 09CA 0000           DATA         0      :
1999 09CB 0000           DATA         0      :
2000 09CC 0000           DATA         0      :
2001 09CD 0000           DATA         0      /
2002            *
2003            *                    MODULE #26
2004            *
2005 09CE 0158  A1A0     DATA       344     NUM COEF. A0
2006 09CF C60F  A1A1     DATA    -14833     NUM COEF. A1
2007 09D0 467D  A1A2     DATA     18045     NUM COEF. A2
2008 09D1 FB95  A1A3     DATA     -1131     NUM COEF. A3
2009 09D2 ED38  B1A0     DATA     -4808     NUM COEF. B0
2010 09D3 540A  B1A1     DATA     21514     NUM COEF. B1
2011 09D4 E115  B1A2     DATA     -7915     NUM COEF. B2
2012 09D5 FFF0  B1A3     DATA       -16     NUM COEF. B3
2013 09D6 0000           DATA         0      \
2014 09D7 0000           DATA         0      :
2015 09D8 0000           DATA         0      :
2016 09D9 0000           DATA         0       >  DELAY CHAIN STORAGE
2017 09DA 0000           DATA         0      :
2018 09DB 0000           DATA         0      :
2019 09DC 0000           DATA         0      :
2020 09DD 0000           DATA         0      /
2021            *
2022            *                    MODULE #27
2023            *
2024 09DE 0187  A1B0     DATA       391     NUM COEF. A0
2025 09DF C4D2  A1B1     DATA    -15150     NUM COEF. A1
2026 09E0 4578  A1B2     DATA     17784     NUM COEF. A2
2027 09E1 FBF7  A1B3     DATA     -1033     NUM COEF. A3
2028 09E2 EC3B  B1B0     DATA     -5061     NUM COEF. B0
2029 09E3 5440  B1B1     DATA     21566     NUM COEF. B1
2030 09E4 E24B  B1B2     DATA     -7605     NUM COEF. B2
2031 09E5 FFEF  B1B3     DATA       -17     NUM COEF. B3
2032 09E6 0000           DATA         0      \
2033 09E7 0000           DATA         0      :
2034 09E8 0000           DATA         0      :
2035 09E9 0000           DATA         0       >  DELAY CHAIN STORAGE
2036 09EA 0000           DATA         0      :
2037 09EB 0000           DATA         0      :
2038 09EC 0000           DATA         0      :
2039 09ED 0000           DATA         0      /
2040            *
2041            *                    MODULE #28
2042            *
2043 09EE 01BB  A1C0     DATA       443     NUM COEF. A0
2044 09EF C398  A1C1     DATA    -15464     NUM COEF. A1
2045 09F0 446B  A1C2     DATA     17515     NUM COEF. A2
2046 09F1 FC54  A1C3     DATA      -940     NUM COEF. A3
```

```
2047 09F2 EB36  B1C0    DATA    -5322    NUM COEF. B0
2048 09F3 546C  B1C1    DATA    21612    NUM COEF. B1
2049 09F4 E37C  B1C2    DATA    -7300    NUM COEF. B2
2050 09F5 FFEF  B1C3    DATA      -17    NUM COEF. B3
2051 09F6 0000          DATA        0    \
2052 09F7 0000          DATA        0    :
2053 09F8 0000          DATA        0    :
2054 09F9 0000          DATA        0     >  DELAY CHAIN STORAGE
2055 09FA 0000          DATA        0    :
2056 09FB 0000          DATA        0    :
2057 09FC 0000          DATA        0    :
2058 09FD 0000          DATA        0    /
2059            *
2060            *                  MODULE #29
2061            *
2062 09FE 01F3  A1D0    DATA      499    NUM COEF. A0
2063 09FF C263  A1D1    DATA   -15773    NUM COEF. A1
2064 0A00 4357  A1D2    DATA    17239    NUM COEF. A2
2065 0A01 FCAB  A1D3    DATA     -853    NUM COEF. A3
2066 0A02 EA2B  B1D0    DATA    -5589    NUM COEF. B0
2067 0A03 548D  B1D1    DATA    21645    NUM COEF. B1
2068 0A04 E4A8  B1D2    DATA    -7000    NUM COEF. B2
2069 0A05 FFF0  B1D3    DATA      -16    NUM COEF. B3
2070 0A06 0000          DATA        0    \
2071 0A07 0000          DATA        0    :
2072 0A08 0000          DATA        0    :
2073 0A09 0000          DATA        0     >  DELAY CHAIN STORAGE
2074 0A0A 0000          DATA        0    :
2075 0A0B 0000          DATA        0    :
2076 0A0C 0000          DATA        0    :
2077 0A0D 0000          DATA        0    /
2078            *
2079            *                  MODULE #30
2080            *
2081 0A0E 022F  A1E0    DATA      559    NUM COEF. A0
2082 0A0F C133  A1E1    DATA   -16077    NUM COEF. A1
2083 0A10 423E  A1E2    DATA    16958    NUM COEF. A2
2084 0A11 FCFD  A1E3    DATA     -771    NUM COEF. A3
2085 0A12 E91A  B1E0    DATA    -5862    NUM COEF. B0
2086 0A13 54A3  B1E1    DATA    21667    NUM COEF. B1
2087 0A14 E5CF  B1E2    DATA    -6705    NUM COEF. B2
2088 0A15 FFF0  B1E3    DATA      -16    NUM COEF. B3
2089 0A16 0000          DATA        0    \
2090 0A17 0000          DATA        0    :
2091 0A18 0000          DATA        0    :
2092 0A19 0000          DATA        0     >  DELAY CHAIN STORAGE
2093 0A1A 0000          DATA        0    :
2094 0A1B 0000          DATA        0    :
2095 0A1C 0000          DATA        0    :
2096 0A1D 0000          DATA        0    /
2097            *
2098            *                  MODULE #31
2099            *
2100 0A1E 0271  A1F0    DATA      625    NUM COEF. A0
2101 0A1F C008  A1F1    DATA   -16376    NUM COEF. A1
2102 0A20 411E  A1F2    DATA    16670    NUM COEF. A2
2103 0A21 FD48  A1F3    DATA     -696    NUM COEF. A3
2104 0A22 E7FB  B1F0    DATA    -6149    NUM COEF. B0
2105 0A23 54A6  B1F1    DATA    21670    NUM COEF. B1
2106 0A24 E720  B1F2    DATA    -6368    NUM COEF. B2
2107 0A25 FFA0  B1F3    DATA      -96    NUM COEF. B3
2108 0A26 0000          DATA        0    \
2109 0A27 0000          DATA        0    :
2110 0A28 0000          DATA        0    :
2111 0A29 0000          DATA        0     >  DELAY CHAIN STORAGE
2112 0A2A 0000          DATA        0    :
2113 0A2B 0000          DATA        0    :
2114 0A2C 0000          DATA        0    :
2115 0A2D 0000          DATA        0    /
2116            *
2117 0A2E       PSLOP   RSS     200
2118      0AF5  PSLOPE  EQU     $-1
2119 0AF6       PSONO   RSS     200
2120      0B8D  PSONOE  EQU     $-1
```

What is claimed is:

1. An apparatus for extracting spectral features from a speech signal, said apparatus comprising:

means, including a polyphase digital filterbank, for extracting a spectral envelope of said speech signal, said envelope being composed of a plurality of spectral envelope segments in frequency bands having uniform bandwidths;

means for reducing said plurality of spectral envelope segments and bands to a predetermined number of compressed spectral envelope segments and bands having non-uniform bandwidths and each compressed spectral envelope segment having an energy level;

means for representing features of said compressed spectral envelope segments in said compressed bands by a first and a second set of binary values, said first set of binary values being representative of the variations between the energy level of each compressed spectral envelope segment and the energy level of an adjacent compressed spectral envelope segment, and said second set of binary values being representative of the relative energy levels of said compressed spectral envelope segments; and means for storing said first and second sets of binary values.

2. Apparatus as claimed in claim 1, further comprising:

means for filtering and digitizing said speech signal and providing said filtered and digitized signal to said means for extracting a spectral envelope, said filtering means having a pass band at least including primary frequencies of the human voice.

3. Apparatus as claimed in claim 1, further comprising:

means for spectrally smearing said speech signal and thereafter providing said speech signal to said means for extracting a spectral envelope.

4. Apparatus as claimed in claim 3 wherein said spectral smearing means comprises:

means for impressing a square wave modulation on said speech signal.

5. Apparatus as claimed in claim 4 wherein said means for impressing a square wave modulation on said speech signal includes:

an input for receiving said speech signal;

a first path and a second path, said first and said second path being in parallel with each other;

a negator, said negator being serially included in said second path;

means connected to said input for periodically switching said speech signal between said first and said second paths; and an output connected to said first and second paths for providing the square wave modulated speech signal.

6. Apparatus as claimed in claim 1, further comprising:

means for sampling said speech signal on a periodic basis and for providing signal samples to said means for extracting whereby said feature representing means generates one said first set and one said second set of binary values for each signal sample.

7. Apparatus as claimed in claim 6, further comprising:

means for representing the total energy of said compressed spectral envelope segments as a binary value.

8. Apparatus as claimed in claim 7 wherein said storing means stores, for each signal sample, said first set, said second set and said binary value representing the total energy of said signal sample as a frame.

9. An apparatus as claimed in claim 8, wherein said storing means stores a plurality of frames, said plurality of frames representing a speech signal, said apparatus further comprising:

means for programmably compressing the frames in said storing means to a predetermined number of frames and outputting said predetermined number of frames as a template representing said speech signal.

10. An apparatus as claimed in claim 1, wherein said polyphase digital filterbank comprises a polyphase network and an odd-time odd-frequency Fourier transformer.

11. An apparatus as described in claim 10, wherein said Fourier transformer provides 32 bands of odd samples and 32 bands of even samples, said apparatus additionally comprising:

means for providing the absolute value of each said sample; and means for time averaging said odd and even samples from said means for providing absolute values.

12. An apparatus as described in claim 11, wherein said time averaging means comprises:

means for summing said odd and even samples of each band; and means for dividing said sums by 2, whereby a single value is provided for each of said 32 bands.

13. A method for extracting spectral features from a speech signal, said method comprises the steps of:

extracting a spectral envelope from said speech signal by filtering said speech signal with a polyphase digital filterbank, said envelope being composed of a plurality of spectral envelope segments in frequency bands having uniform bandwidths;

reducing said plurality of spectral envelope segments and bands to a predetermined number of compressed segments and bands having non-uniform bandwidths and each compressed segment having an energy level;

binarily encoding features of said compressed segments into a first and a second set of binary values representing the variations between the energy level of each compressed segment and the energy level of the next higher compressed segment as said first set, and representing relative energy levels of said segments as said second set; and storing said first and second sets of binary values.

14. Method as claimed in claim 13, further comprising the steps of:

filtering and digitizing said speech signal prior to extracting said spectral envelope, said filtering passing the primary frequencies of the human voice.

15. Method as claimed in claim 13 further comprises the step of:

spectrally smearing said speech signal before extracting said spectral envelope.

16. Method as claimed in claim 15 wherein said spectral smearing step comprises:

impressing a square wave modulation on said speech signal.

17. Method as claimed in claim 16 wherein the step of impressing a square wave modulation on said speech signal comprises the steps of:

providing first and second paths in parallel with each other, said second path including a negator; and periodically switching said speech signal between said first and second paths, whereby a square wave modulation is impressed on said speech signal.

18. Method as claimed in claim 13, further comprises the step of:

sampling said speech signal on a periodic basis prior to extracting said spectral envelope whereby said binary encoding step generates one said first set and one said second set of binary values for each signal sample.

19. Method as claimed in claim 18, further comprising the steps of:

representing the total energy of said compressed segments as a binary value.

20. Method as claimed in claim 19 wherein said storing step includes storing, for each signal sample, said first set, said second set and said binary value representing the total energy of said signal sample as a frame.

21. A method as claimed in claim 20, additionally comprising the steps of:

storing a plurality of frames, said plurality of frames representing a speech signal;

programmably compressing the stored frames to a predetermined number of frames; and outputting said predetermined number of frames as a template representing said speech signal.

22. A method as described in claim 13, wherein said step of extracting a spectral envelope provides 32 bands of odd samples and 32 bands of even samples, said method additionally comprising the steps of:

providing the absolute value of each said sample; and time averaging the absolute values of said odd and even samples to provide a single output of each of said 32 bands.

23. A method as described in claim 22, wherein said step of time averaging comprises the steps of:

summing said odd and even samples of each band; and dividing said sums by 2.

* * * * *